US006928667B2

(12) United States Patent
Nicolaas Kuhn

(10) Patent No.: US 6,928,667 B2
(45) Date of Patent: Aug. 16, 2005

(54) DEVICE WITH MULTIPLE TOILET CARE ACTION

(75) Inventor: Petrus Henricus Aloysius Nicolaas Kuhn, The Hague (NL)

(73) Assignee: Sara Lee/De N.V. (NL)

( * ) Notice: Subject to any disclaimer, the term of this patent is extended or adjusted under 35 U.S.C. 154(b) by 0 days.

(21) Appl. No.: 10/416,130

(22) PCT Filed: Nov. 19, 2001

(86) PCT No.: PCT/NL01/00832

§ 371 (c)(1),
(2), (4) Date: Sep. 4, 2003

(87) PCT Pub. No.: WO02/40792

PCT Pub. Date: May 23, 2002

(65) Prior Publication Data

US 2004/0060103 A1 Apr. 1, 2004

(30) Foreign Application Priority Data

Nov. 17, 2000 (NL) ..... 1016631

(51) Int. Cl.[7] ..... E03D 9/02
(52) U.S. Cl. ..... 4/231
(58) Field of Search ..... 4/231

(56) References Cited

U.S. PATENT DOCUMENTS 6,230,334 B1 * 5/2001 Camp et al. ..... 4/231
6,389,610 B1 * 5/2002 Hautmann et al. ..... 4/231
6,505,356 B1 * 1/2003 Leonard et al. ..... 4/231

FOREIGN PATENT DOCUMENTS

| | | |
|---|---|---|
| EP | 0 785 315 A1 | 7/1997 |
| EP | 0 878 586 A2 | 11/1998 |
| EP | 0 960 984 A2 | 12/1999 |

* cited by examiner

*Primary Examiner*—Charles E. Phillips
(74) *Attorney, Agent, or Firm*—Altera Law Group, LLC

(57) ABSTRACT

A device with multiple toilet care action is provided with a reservoir for an active substance and suspension means for suspending the device from the rim of a toilet bowl such, that with every flushing operation, an active substance is dispensed to the flushing water in the toilet bowl. The reservoir is provided with at least two compartments for such an active substance. In a particular embodiment, in the compartments, active liquids have been disposed. In this situation, the device is provided with a holder, a bottle with said compartments detachably connected to the holder and a liquid collecting element which, when the device is suspended from the rim of a toilet bowl, is located in the path of the flushing water in the toilet bowl for adding thereto with each flushing operation an active liquid, the contents of the compartments being in constant communication with the liquid collecting element.

20 Claims, 25 Drawing Sheets

DEVICE WITH MULTIPLE TOILET CARE ACTION

The invention relates to a device with multiple toilet care action, provided with a reservoir for an active substance and suspension means for suspending the device from the rim of the toilet bowl such, that with every flushing operation an active substance is imparted to the flushing water in the toilet bowl. The reservoir can contain an active liquid, but also a cleansing block of an active, water-soluble substance.

Insofar as the reservoir is suitable for an active liquid, such a device is known from the European patent specification 0 785 315. The multiple action of this known device consists in a cleansing of the toilet bowl with every flushing operation and a permanent spread of a fresh odour in the toilet space. To that end, the bottle comprises a reservoir for a cleansing liquid in which a volatile substance for the distribution of a fresh odour has been dissolved. The liquid collecting element can be formed by a porous mass via which the contents of the reservoir are in communication with the ambient air. With the aid of a liquid discharge opening and an air supply opening, both of suitably selected dimensions, the liquid pressure on the porous mass is always kept substantially equal and independent of the liquid level in the reservoir, so that during the entire service life of the bottle, always a substantially constant saturation of the porous mass is effected. After each flushing operation, this condition of saturation is restored, while via the porous mass a permanent distribution of the volatile component takes place. Instead of a porous mass, the liquid collecting element can also be formed by one or more highly constricted discharge openings or by a plug provided with narrow flow-through openings in the discharge openings of the compartments.

Although, in practice, such a device is quite adequate, the use is limited; apart from the twofold toilet care action mentioned, it is desired to give the device a more than twofold action. For instance, it can be desired that also a component be spread effecting the prevention of lime formation and/or a component with a bleaching effect. Often, these components cannot be combined with the components already present in the reservoir.

Accordingly, the object of the invention is to provide a device with multiple toilet care action, allowing, in this respect, a wider use than the device already known.

To that end, according to the invention, the device as described in the preamble is characterized in that the reservoir is provided with at least two compartments for an active substance. Insofar as the at least two compartments are filled with an active liquid, the device is further characterized in that it is provided with a holder, a bottle optionally detachably connected to the holder, with a reservoir comprising the at least two compartments, and a liquid collecting element, which, when the device is suspended from the rim of the toilet bowl, is located in the path of the flushing water in the toilet bowl for adding thereto, with each flushing operation, an active liquid, the contents of the compartments being in constant communication with the liquid collecting element. What is meant in this context by constant communication is a communication such, that the liquid collecting element is continuously or periodically, for instance dropwise provided with an active substance.

As soon as several compartments are provided in the reservoir, the problem occurs that the liquids in these compartments can have a different viscosity. On the basis of these different viscosities and, further, on the basis of variations in the size of the liquid discharge openings of the compartments, the discharge velocity of the liquids may vary, so that one compartments is empty faster than the other. Such a difference can run up to a length of time of several days. To prevent this, an equal reduced pressure in both air spaces has to be provided for. According to the invention, this is realised in that a connecting element is present which the aid of which the compartments can be brought into communication with each other when the device is put into use.

As mentioned hereinabove, the bottle is optionally detachably connected to the holder. Then, the bottle can be distributed separately from the holder, while, naturally, the liquids in the compartments are not to mix with each other. For the embodiment with the detachable bottle, the invention is therefore further characterized in that, before the bottle is fitted onto the holder, the connecting element seals off the compartments separately. In conjunction therewith, the connecting element preferably comprises sealing and releasing means with the aid of which, when the bottle is fitted onto the holder or shortly before or after this, the air spaces in each of the compartments are brought into communication with each other. When fitting the bottle onto the holder, the communication between the two air spaces can be immediately effected. It is also possible that this is done by manually operating a button; then, this can take place shortly before the bottle is fitted onto the holder or shortly afterwards. Such a button can also be used with a bottle integrated in the holder or fixedly connected thereto.

In a concrete embodiment, the device is characterized in that two compartments are present and the connecting element is provided with an open, tubular element, arranged in each of the compartments, the upper end of which tubular element terminates in a respective air space, and the two lower ends of which tubular elements are in communication with each other, and, further, that the sealing and releasing means are formed by two rod-shaped elements, each of which extends through a respective tubular element and each of which, as long as the bottle has not yet been fitted onto the holder, seals off the respective tubular element and, when the bottle is fitted onto the holder, brings the air spaces in communication with each other. This means that, as soon as the bottle has been fitted onto the holder, the device is to be kept upright and is to be suspended in this position from the rim of the toilet bowl, in order that the liquids in the two compartments do not mix with each other. The connecting element with the sealing and releasing means can also be formed by an up-and-down movable partition plate or a small cock.

Further, it proves to be favourable when the device, such as it has been described so far, is combined with a cleansing block. According to the invention, the reservoir is provided to that end with a compartment with a block of an active substance provided therein which, when the device has been suspended from the rim of the toilet bowl, is also in the path of the flushing water in the toilet bowl for adding to the toilet bowl, with each flushing operation, an amount of active substance dissolved in the flushing water.

Devices to be suspended from the rim of a toilet bowl consisting of a holder in which a flat-lying cleansing block is provided have been known for a long time and have the disadvantage that no continuous release of substance to the flushing water is obtained, that the solubility of the substance is often insufficient and that the cleansing block, as it becomes smaller, strongly crumbles. These disadvantageous effects notably occur because during flushing, the flushing water flows over the entire block. To prevent these disadvantageous effects from occurring with the combined device according to the invention, the block has been designed and disposed such that during the greatest part of its service life, during flushing operations, it only partly comes into contact with the flushing water. Hence, each time, only a part of the block gives off active substance to the flushing water. The remaining part of the block remains dry. When, furthermore, the block is composed and arranged such that, during the greatest part of service life of the block, the part of it coming into contact with the flushing water is constant, a uniform discharge of active substance is obtained. The fact is that because at each flushing operation a small portion of the block dissolves, the entire block comes down somewhat, so that after each flushing operation, a substantially identical surface of the block comes into contact with the flushing water. Only by the end of service life a reduced dosage to the flushing water can occur, while, at the very last moment, a chance of crumbling still exists. However, it is found that with the features according to the invention, the service life can be considerably lengthened in comparison with the known cleansing blocks arranged flat in the reservoir. In a preferred embodiment the block is beam-shaped and vertically disposed.

In the above-mentioned concrete embodiment, the respective compartment can be implemented by arranging it between the two liquid compartments. Then, it is favourable when the respective compartment is provided with a discharge opening which is located at substantially the same height as the liquid collecting element.

The invention not only relates to a device as described hereinabove but also to a bottle which can be put into circulation separately, with a reservoir comprising several compartments for different active substances, usable in combination with a holder as described hereinabove.

The invention will presently be elucidated on the basis of the accompanying drawing. In the drawing.

Figure 16:
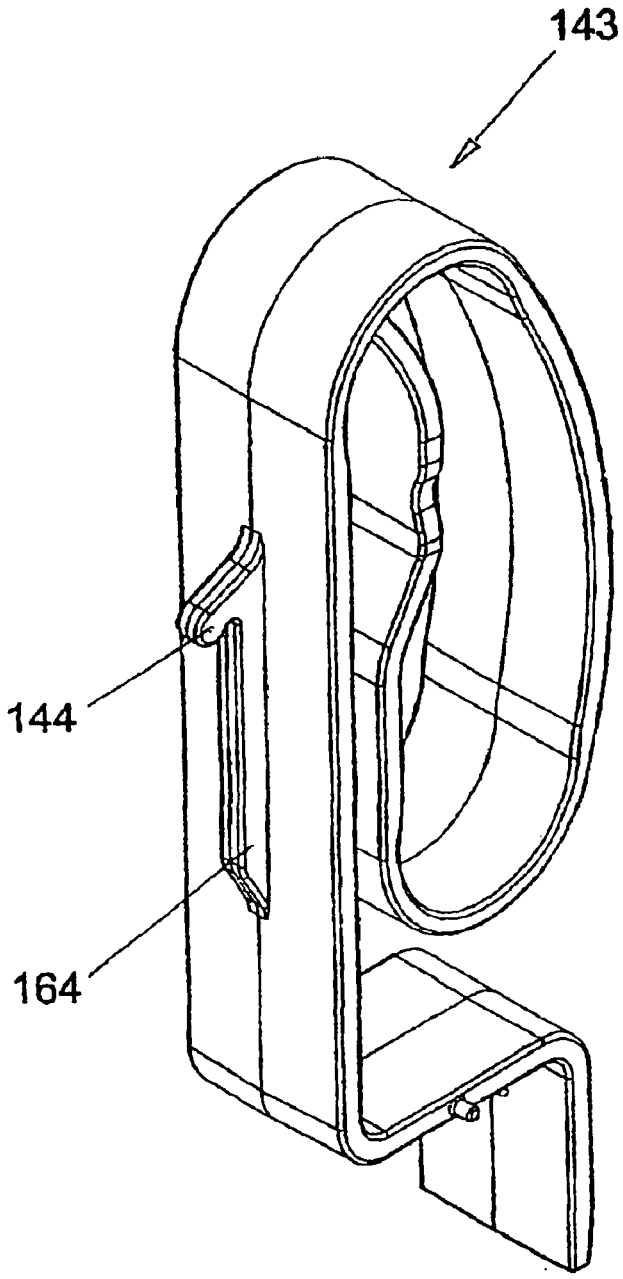
Figure 17:
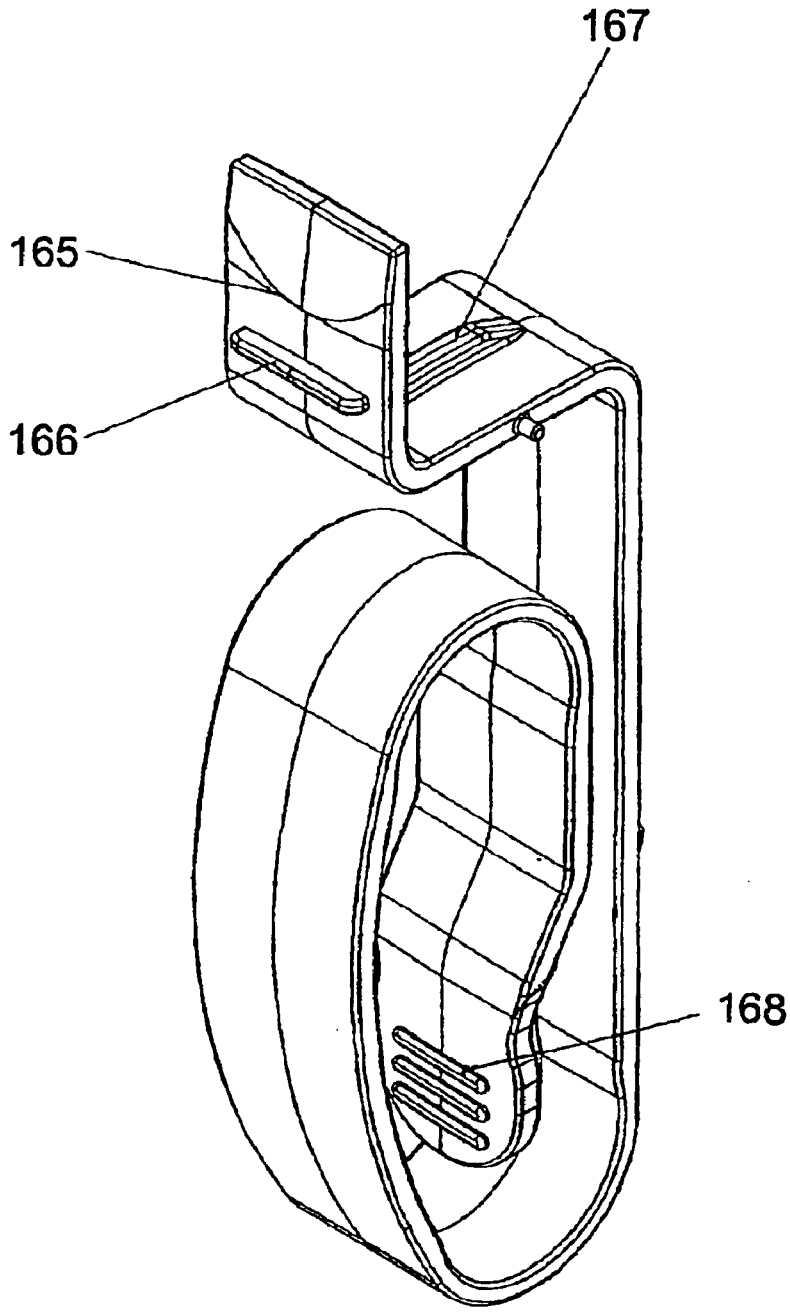
Figure 18:
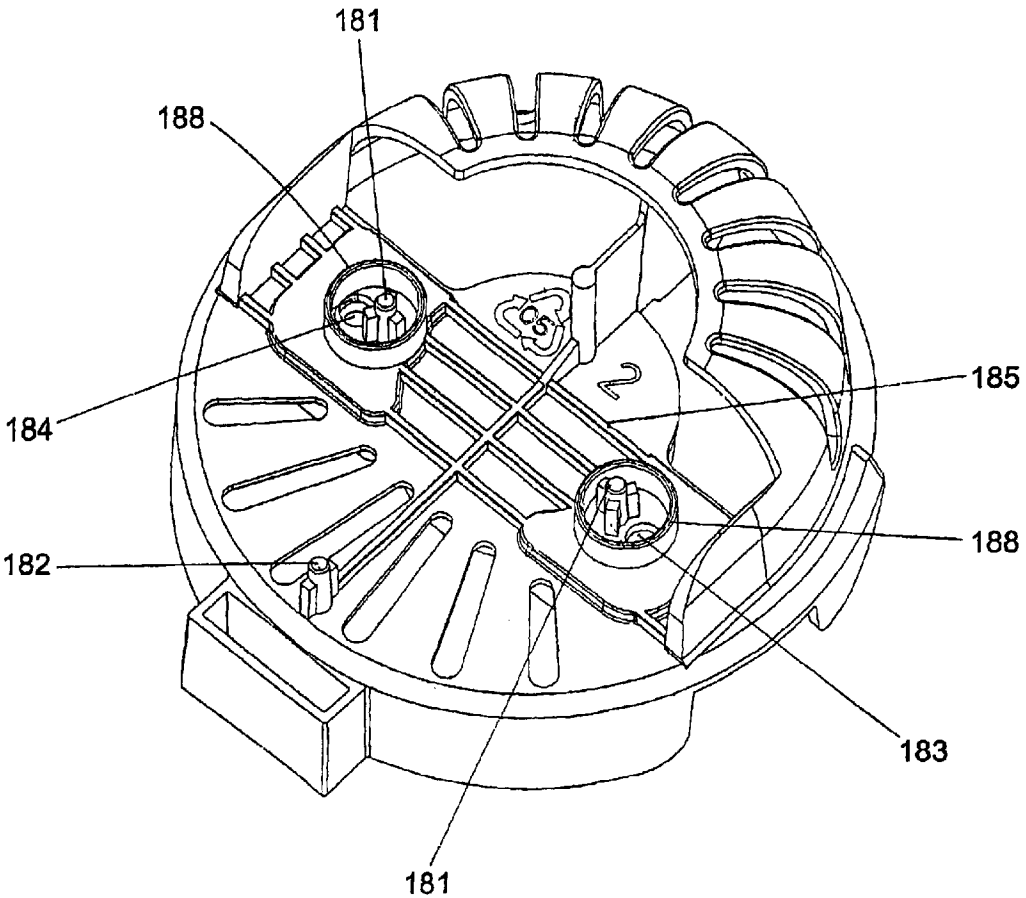
Figure 19:
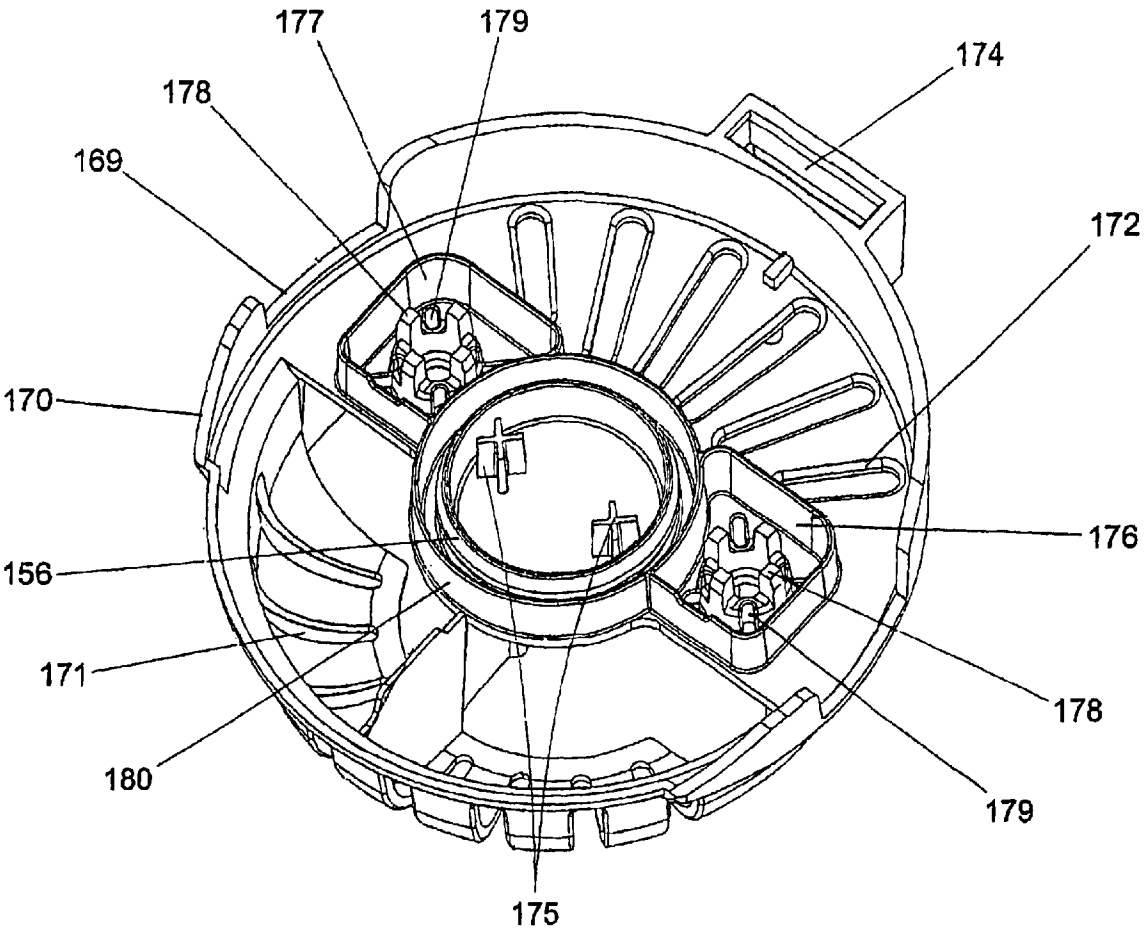
Figure 20:
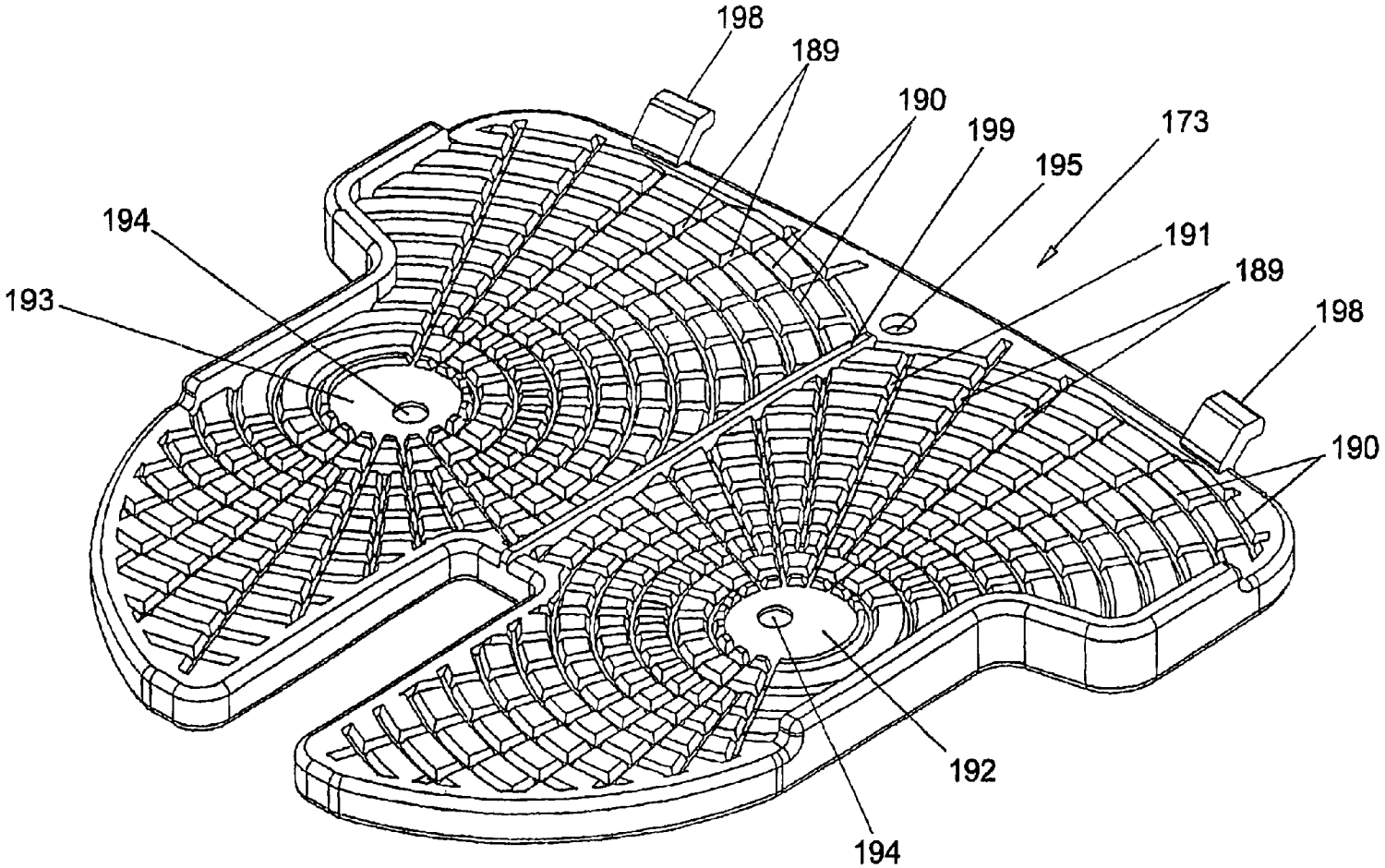
Figure 21:
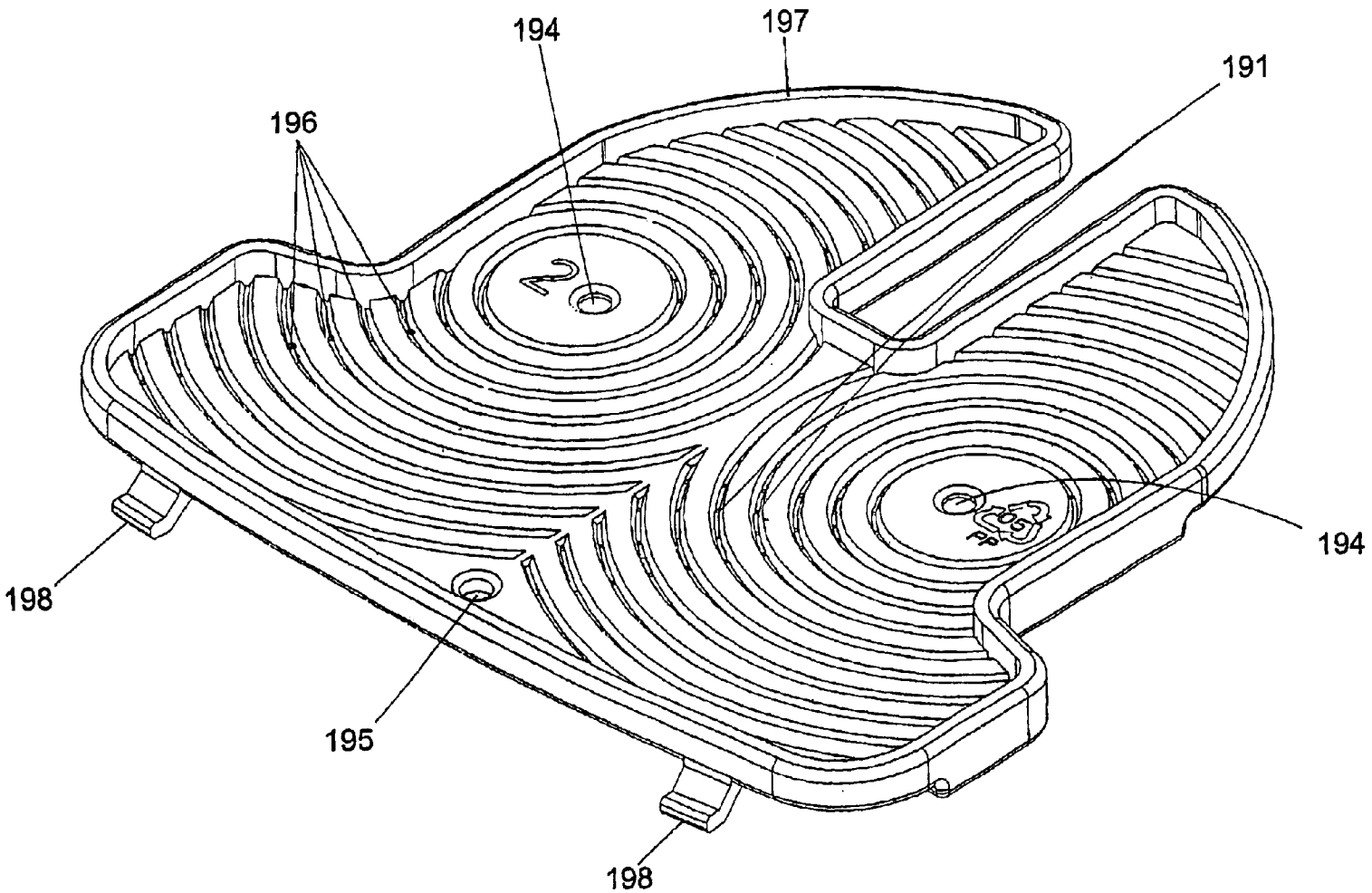
Figure 23:
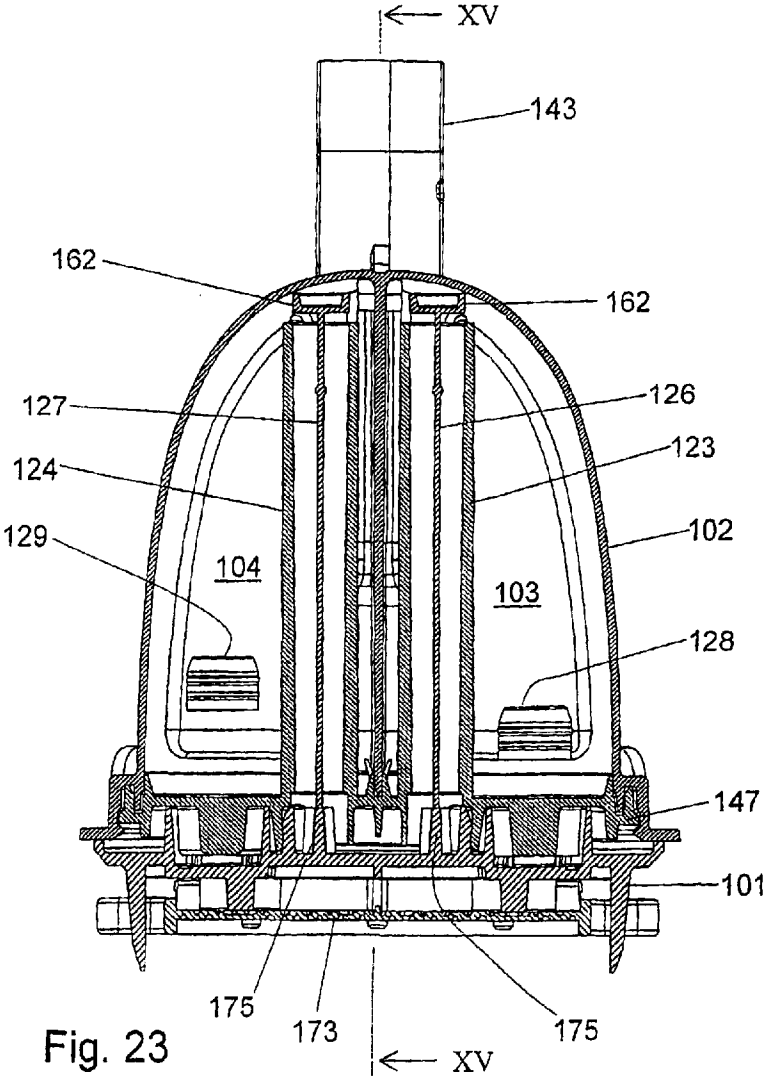
Figure 22:
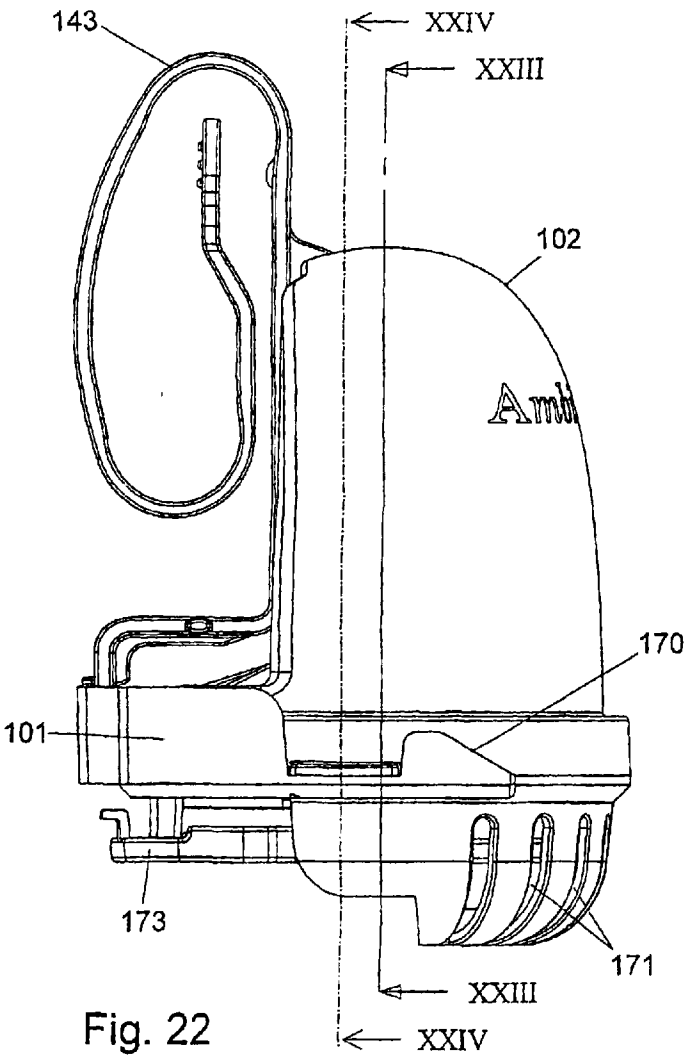
Figure 24:
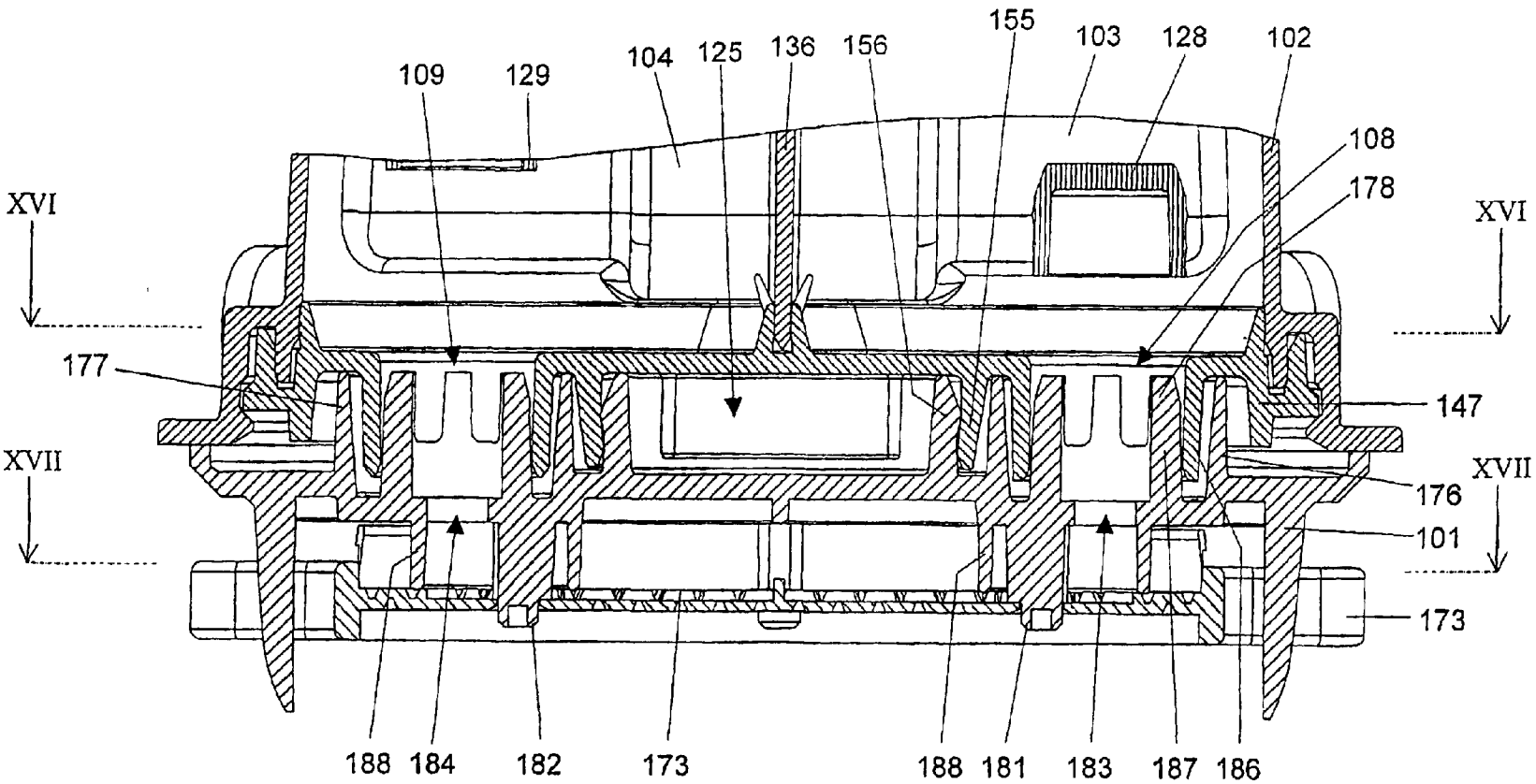
Figure 25:
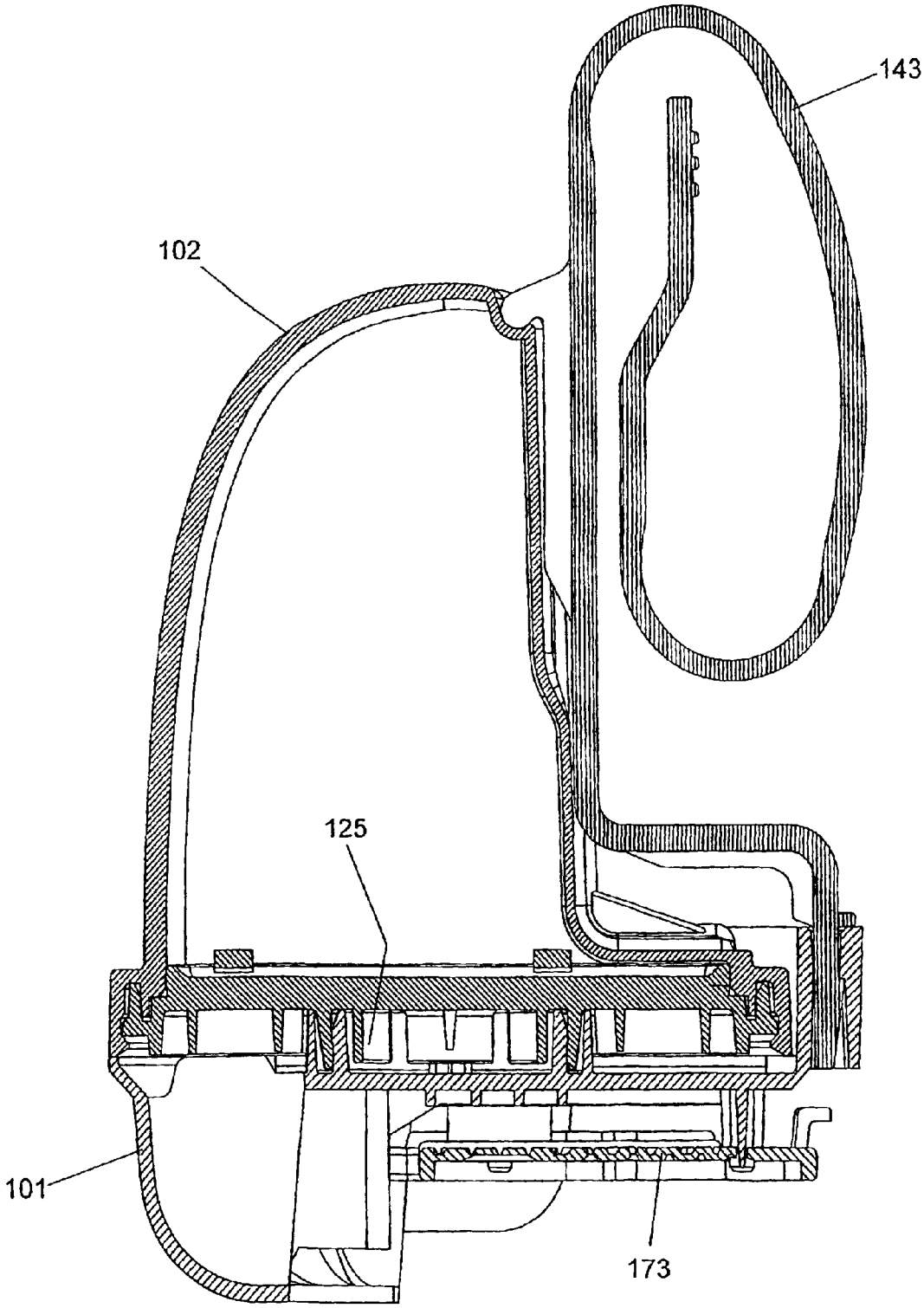
Figure 26:
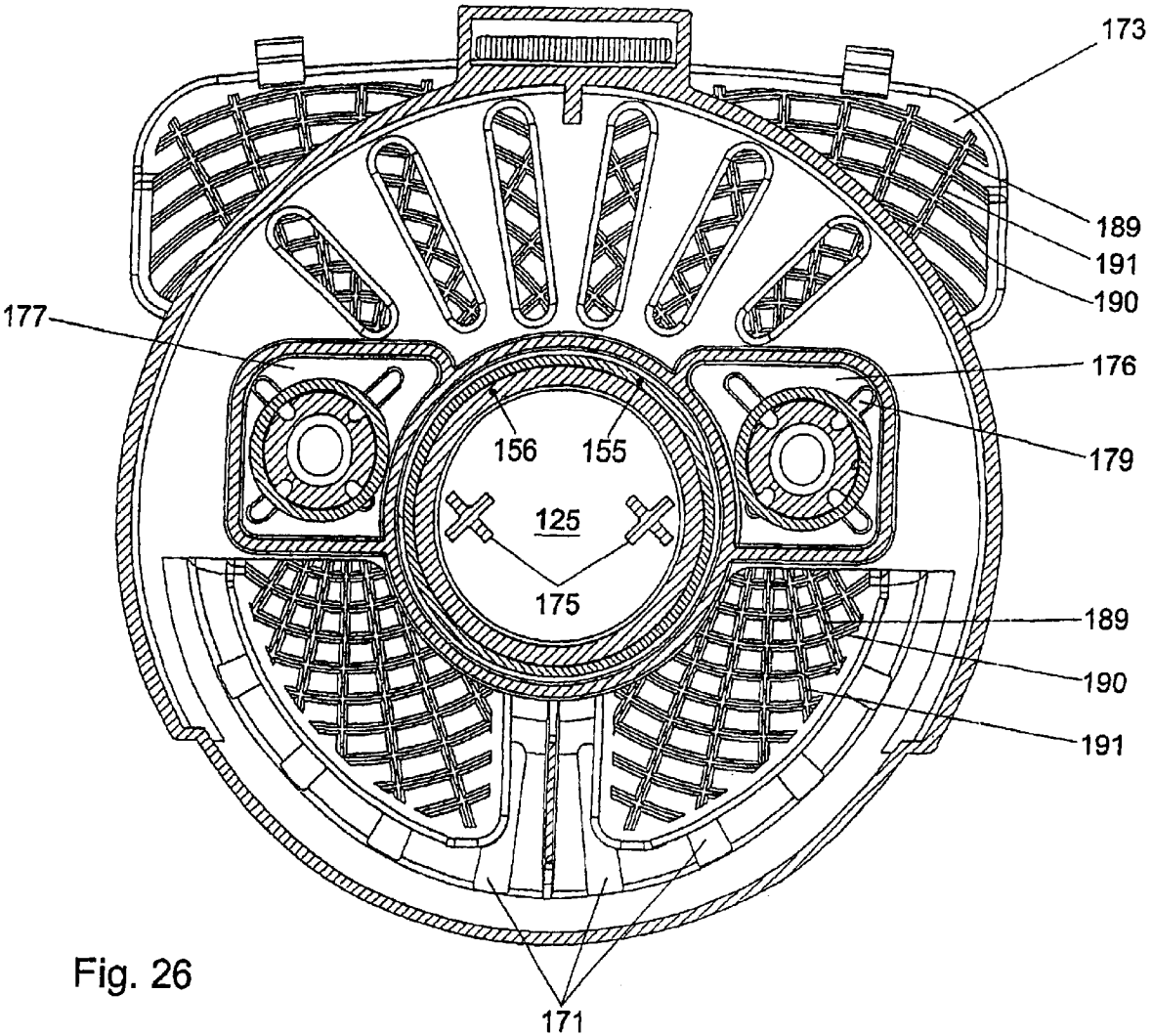
Figure 27:
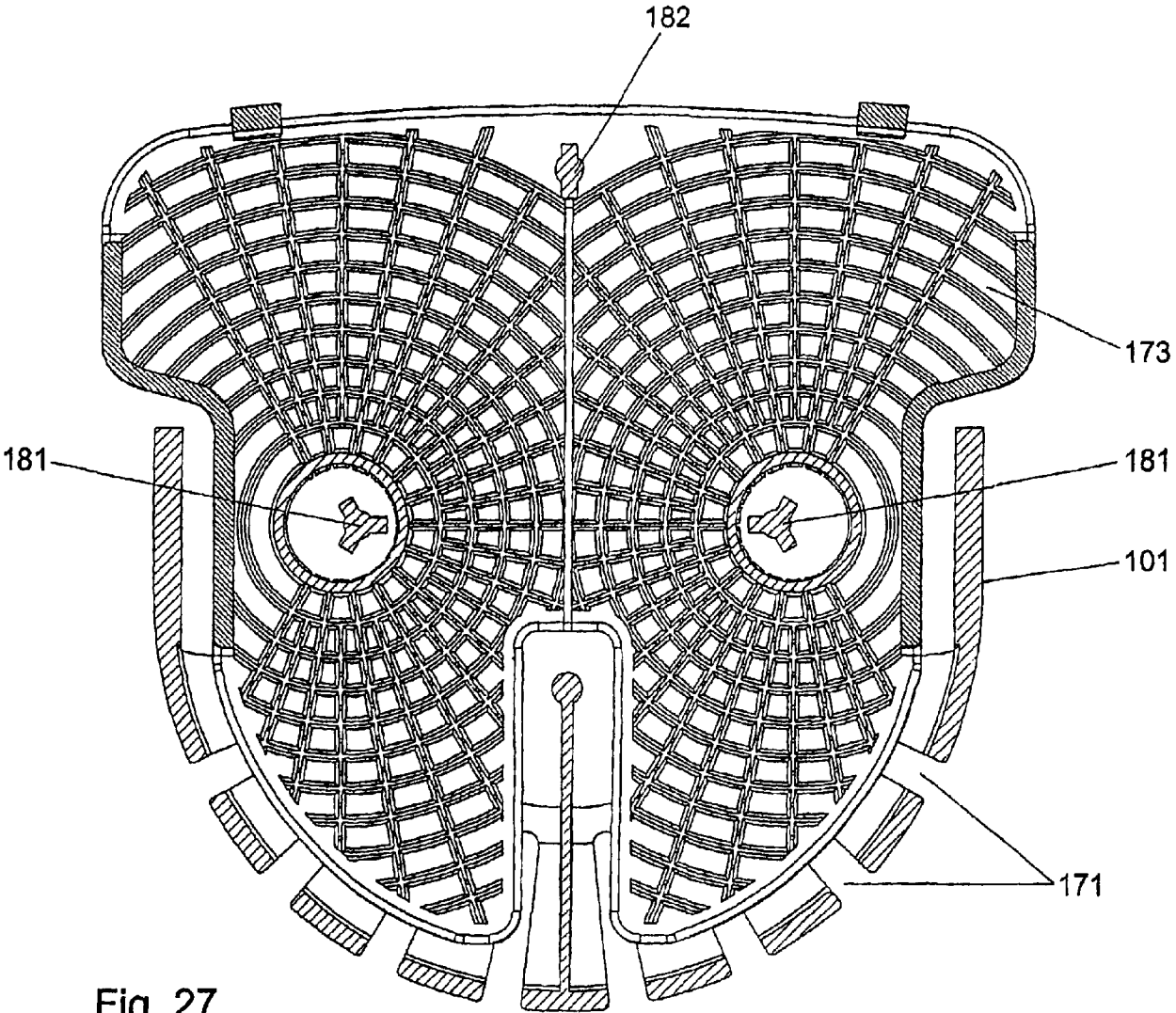
Figure 28:
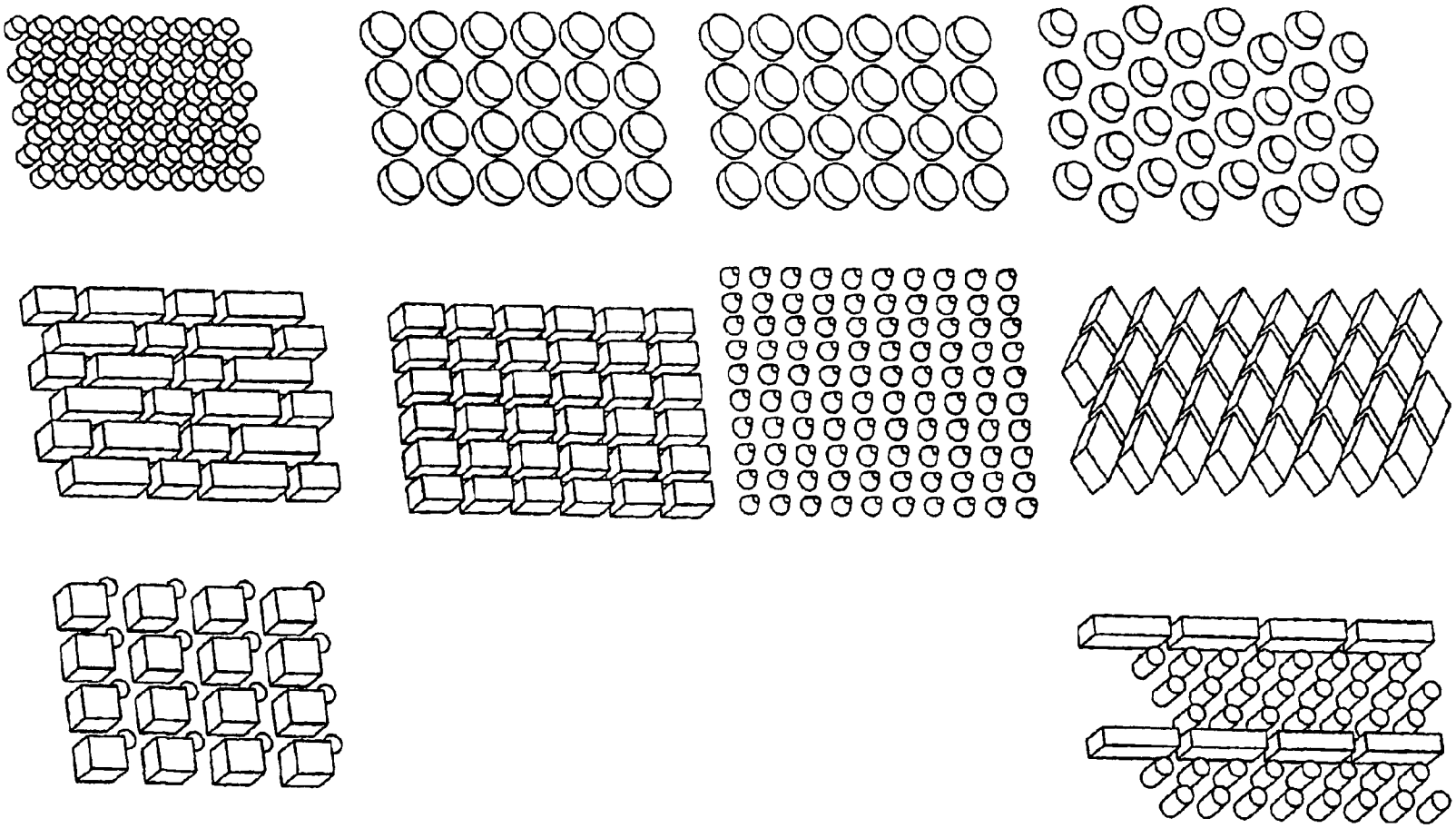

FIGS. 16 and 17 both show a perspective view of a flexible bracket with the aid of which the device can be suspended from the rim of a toilet bowl;

FIGS. 18 and 19 show a bottom and top plan view, respectively, of the holder whereon the bottle can be attached;

FIGS. 20 and 21 show a perspective top and bottom plan view, respectively, of a liquid collecting element used in the third exemplary embodiment;

FIG. 22 shows a side view of the third exemplary embodiment;

FIG. 23 shows a cross-sectional view along the line XXIII—XXIII of FIG. 22 over the tubular elements;

FIG. 24 shows in detail the discharge openings of the bottle in assembled condition on the holder;

FIG. 25 shows a cross sectional view along line XXV—XXV of FIG. 23;

FIG. 26 shows a cross sectional view along line XXVI—XXVI of FIG. 24;

FIG. 27 shows a cross sectional view along line XXVII—XXVII of FIG. 24; and FIG. 28 shows a number of possible alternative surface structures for the liquid collecting element.

In the Figures, corresponding parts are indicated with the same reference numerals.

The exemplary embodiment represented in FIGS. 1–6 of a device with multiple toilet care action according to the invention comprises a holder 1, a bottle 2 with a reservoir for an active liquid, detachably connected to the holder. Here, this reservoir has two compartments 3 and 4, separated by a wall 36. The suspension means connected to the holder for suspending the device from the rim of the toilet bowl are not represented here. These can be identical to those in the earlier mentioned European patent application 0 785 315. The device is further provided with a liquid collecting element 5 in the form of a porous, liquid absorbing mass, which, when the bottle 2 is pushed onto the holder 1, is always in fluid communication with the liquid in the compartments 3 and 4. The porous mass is arranged in the holder 1 such, that it is located in a path of the flushing water when the device is in suspended condition from the rim of the toilet bowl. The porous mass can for instance be designed as a sponge or as a small plate of sintered, porous material.

The holder 1 is provided with two connecting nipples 6 and 7 to which a respective discharge opening 8, 9, respectively, of the compartments 3, 4, respectively, is connectable, so that the discharge openings, in the condition suspended from the rim of the toilet bowl, are directed downwards. In the condition connected to the connecting nipple 6, 7, respectively, the discharge openings 8 and 9 are partly sealed off by a closing wall 10, 11, respectively, each of which is provided with at least one liquid passage opening 12, 13, respectively, which terminates in a channel 14, 15, respectively. The outlet of each of these channels abuts against the porous mass with a limited surface. Further, the closing wall 10, 11, respectively, has an air supply opening 16, 17, respectively, which is in communication with the ambient pressure. The dimensions of the liquid passage opening and the air supply opening are adjusted to each other and to the viscosity of the liquid present in the liquid reservoir such, that the liquid pressure on the porous mass is always substantially equal and independent of the liquid level in the compartment.

As is clearly represented in FIGS. 1–6, the holder 1 is manufactured from a first moulded piece 18, of which the suspension means form part. The connecting nipples 6, 7, the closing walls 10, 11, the liquid passage means 12, 13, the air supply openings 16, 17 and the channels 14, 15 form part of a second moulded piece 19 which is detachably connected to the first moulded piece 18 via a snap connection. The porous mass 5 is clamped-in between the first moulded piece 18 and the second moulded piece 19. Further, the first moulded piece 18 comprises discharge channels or capillaries 31 terminating in the porous mass, for discharging liquid present in the porous mass 5 during a flushing operation.

The discharge openings 8 and 9 of the bottle 2 each are closed off by a sealing cap (not represented) which, when placing the bottle 2 on the holder 1, is pushed into the respective compartment, so that the compartments 3 and 4 are opened and the discharge openings 8 and 9 are cleared. What is thus achieved, is that, when placing the bottle 2 in the holder 1, simultaneously, the compartments 3 and 4 are opened. The sealing caps can be such that they will float on the liquid in the respective compartments; naturally, they can also be hingedly arranged on or adjacent the discharge openings. The operation of the holder and the release of liquid from a compartment is, for that matter, identical to that described in the earlier mentioned European patent application 0 785 315, the contents of which is understood to form part of the description given here of the embodiment of FIGS. 1–6.

As long as the bottle 2 has not yet been fitted onto the holder 1, the compartments have to be separated from each other, while this separation is to be removed as soon as the bottle 2 has been fitted onto the holder 1 and the air spaces 20 and 21, at the top of the compartments 3, 4, respectively, are brought in communication with each other, such that the pressure in the two spaces always remains equal and the discharge from the two compartments in time will be substantially equal. Apart from the air supply through the air supply openings 16 and 17 and through the liquid in the compartments, the air spaces need to be completely closed off from the ambient air. To have the pressure in the two air spaces always equal to each other, a connecting element 22 is present which is provided with an open, tubular element 23, 24, respectively, arranged in each of the compartments 3 and 4, the upper ends of which tubular elements terminating in a respective air space and the lower ends being in communication with each other via a chamber 25. The connecting element further comprises closing and release means which are formed by two rod-shaped elements 26 en 27. These rod-shaped elements 26 and 27 extend through a respective tubular element 23, 24, respectively, and are provided at the upper extremity with a sealing plug 28, 29 respectively. As long as the bottle 2 has not been placed on the holder yet, the upper extremity of the tubular elements 23 and 24 is sealed off by the sealing plugs 28, 29 respectively. When the bottle is placed on the holder, the rod-shaped elements 26 and 27 are pushed upwards against a projecting edge 30 in the second moulded piece 19, so that the sealing plugs 28 and 29 are pushed further into the air spaces 20, 21, respectively, and, via the interior of the tubular elements 23 and 24 and the chamber 25, an air communication is realized between the two air spaces 20 and 21. As soon as the bottle 2 is placed onto the holder 1, the device will have to be held more or less upright and be suspended in this condition from the rim of the toilet bowl.

Figure 1:
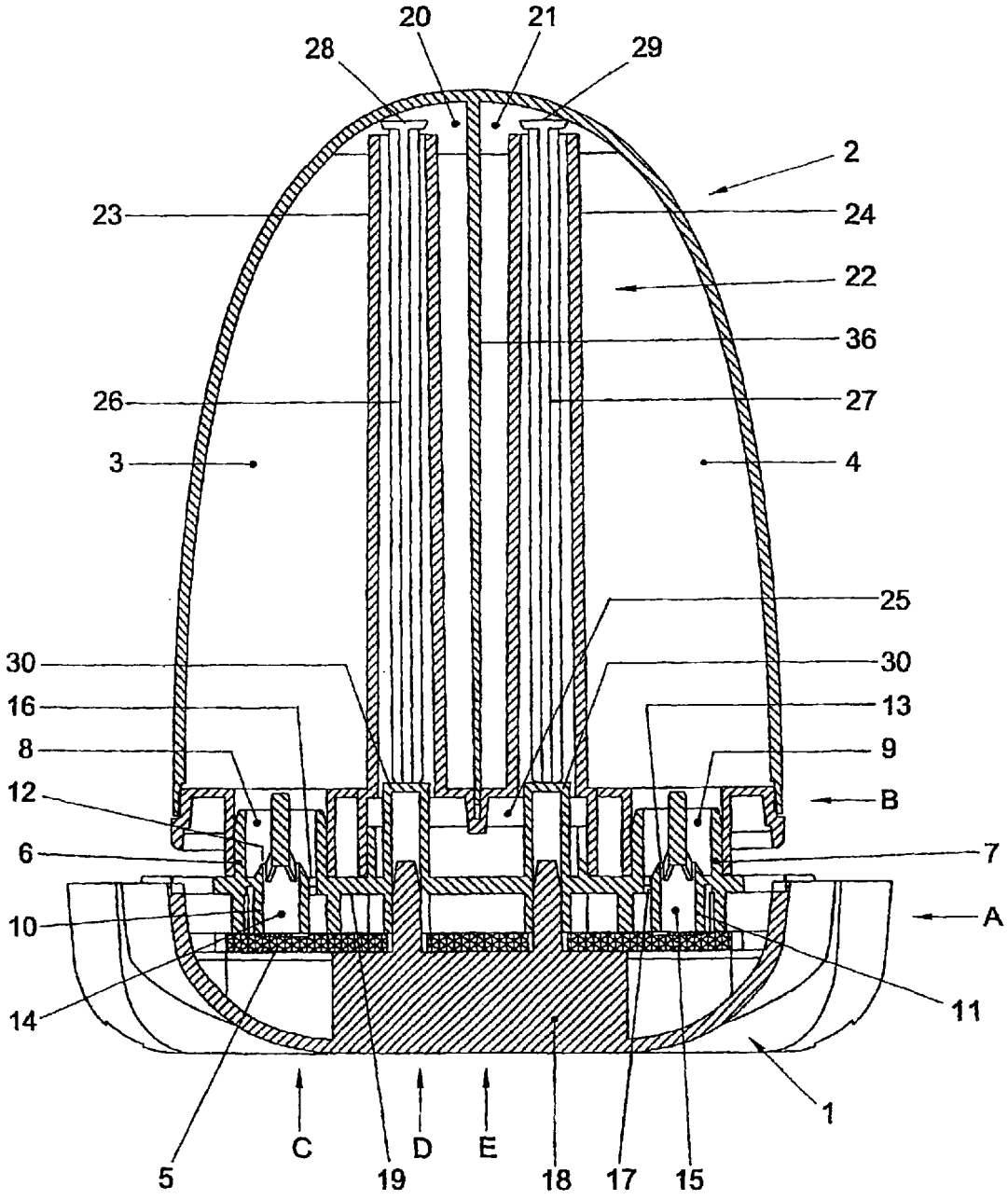
FIG. 1 shows a longitudinal section of an exemplary embodiment of the device according to the invention.
Figure 2:
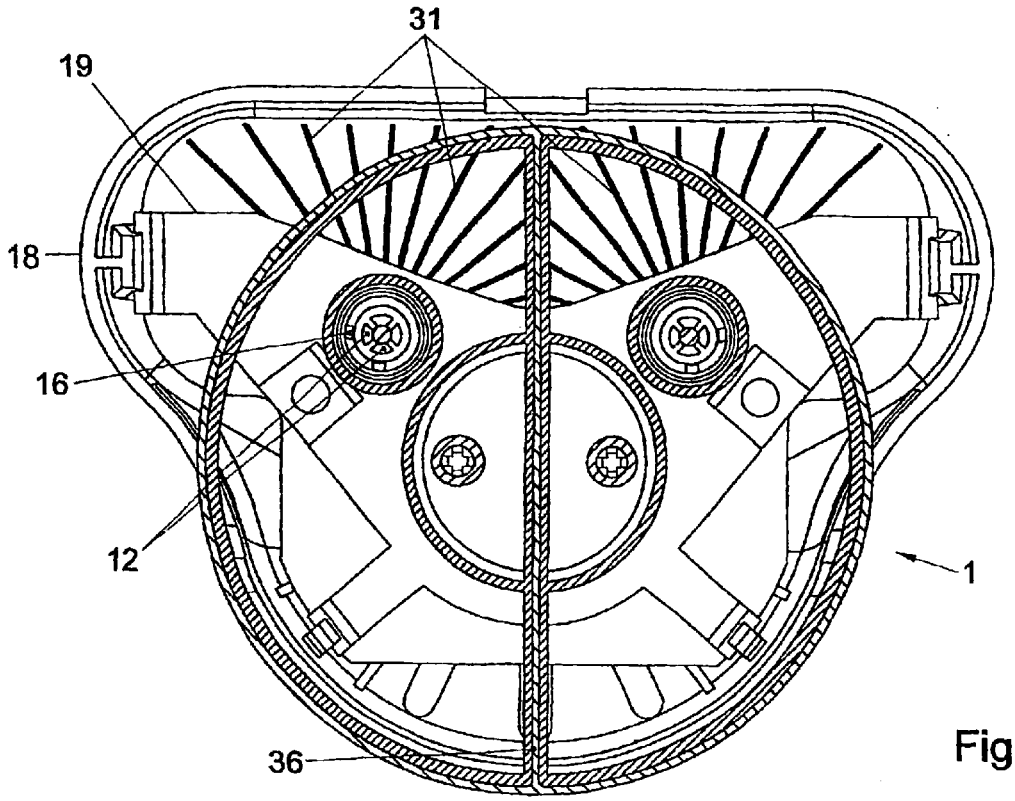
FIG. 2 shows a cross section of this exemplary embodiment at the height indicated with A in FIG. 1.
Figure 3:
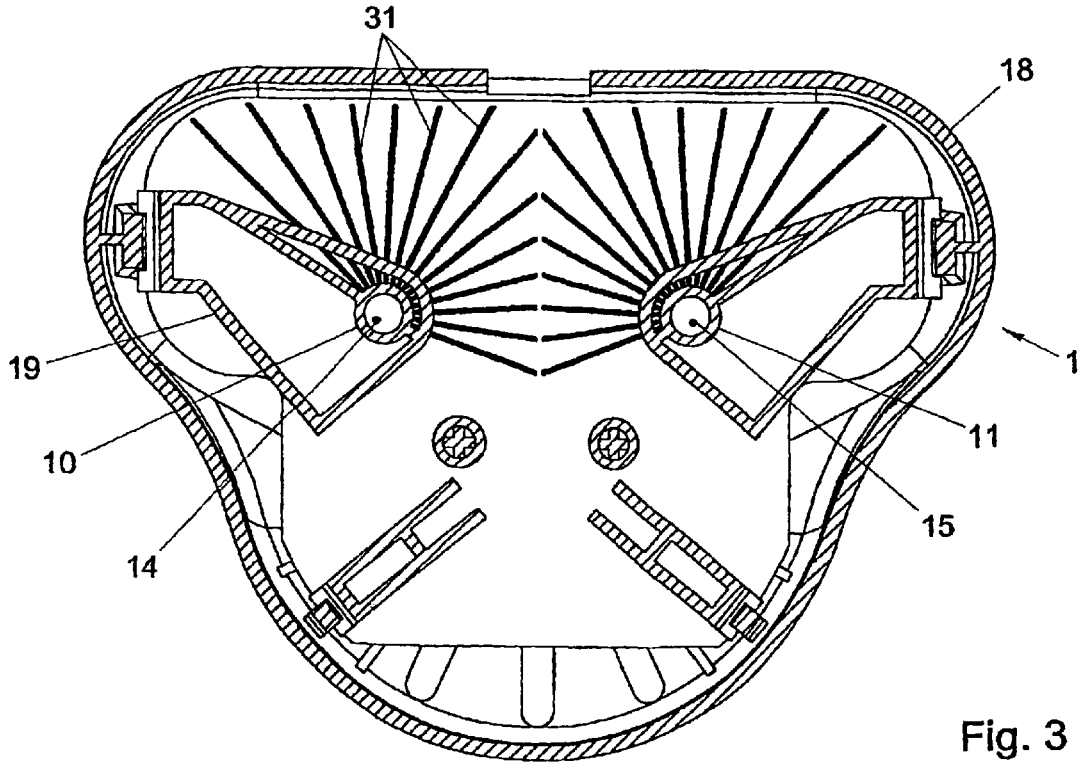
FIG. 3 shows a cross section of this exemplary embodiment at the height indicated with B in FIG. 1.
Figure 4:
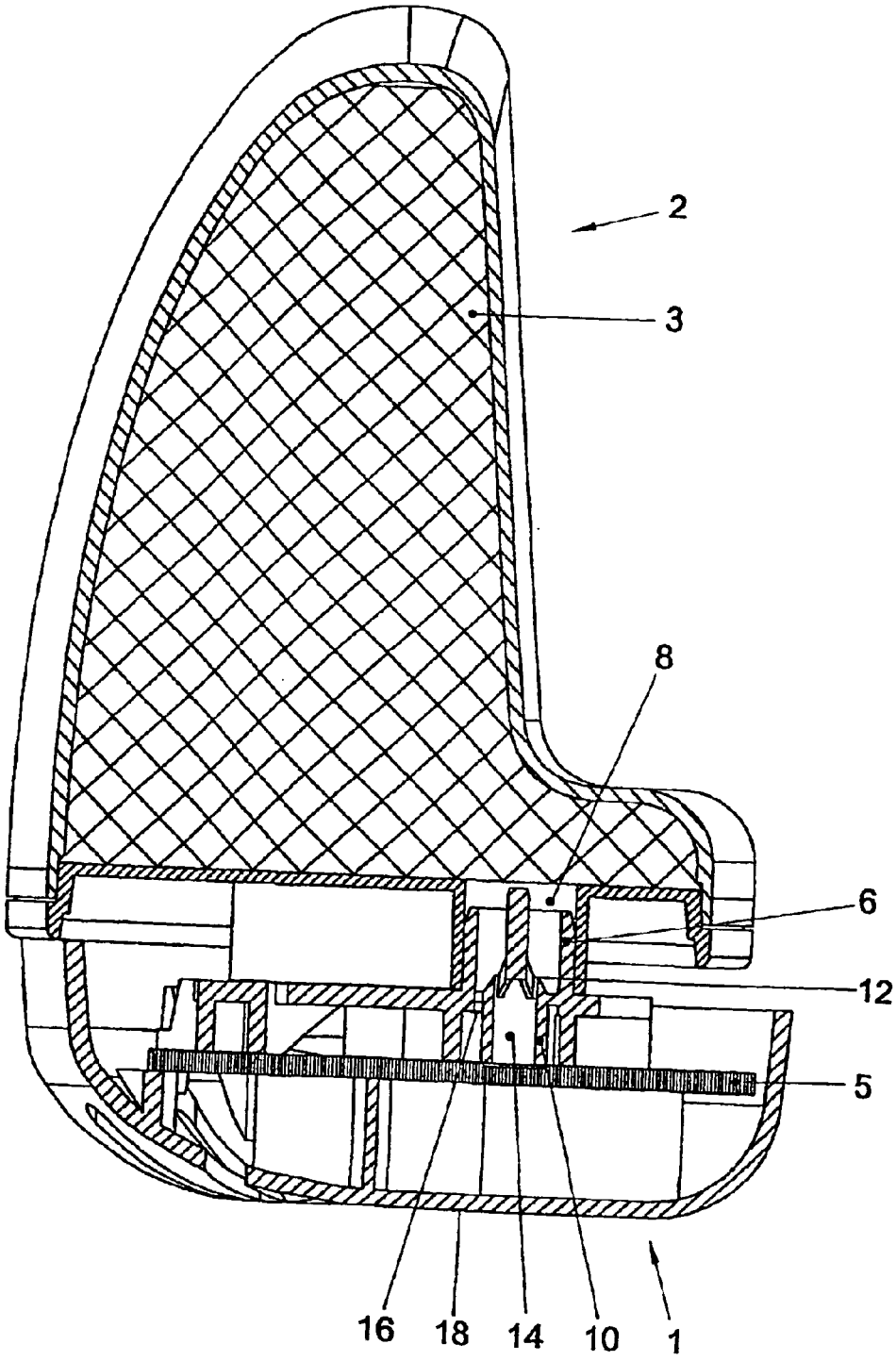
FIG. 4 shows a longitudinal section of this exemplary embodiment, perpendicular to the longitudinal section of FIG. 1 at the location indicated with C in FIG. 1.
Figure 5:
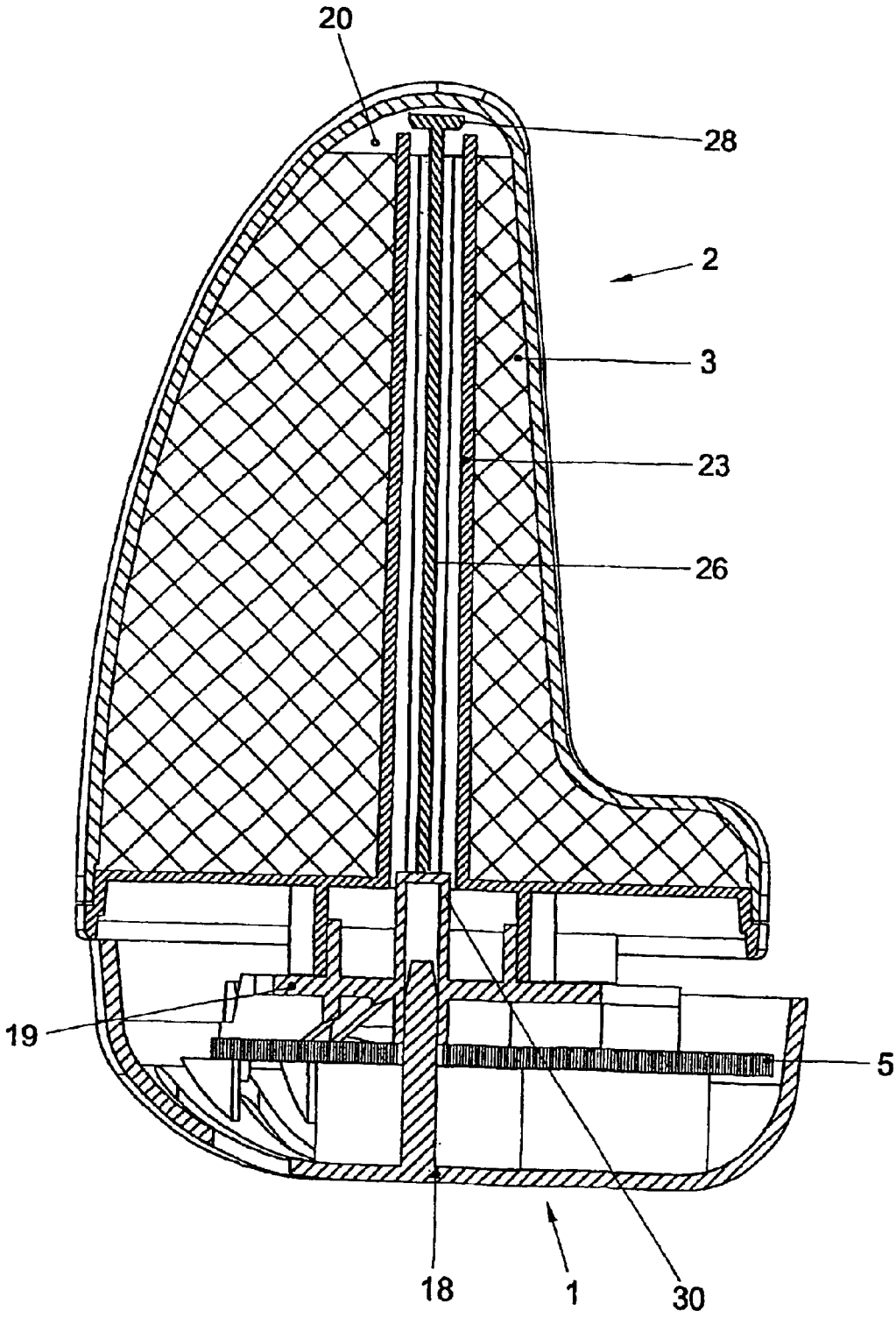
FIG. 5 shows a longitudinal section of this exemplary embodiment, perpendicular to the longitudinal cross section of FIG. 1 at the location indicated with D in FIG. 1.
Figure 6:
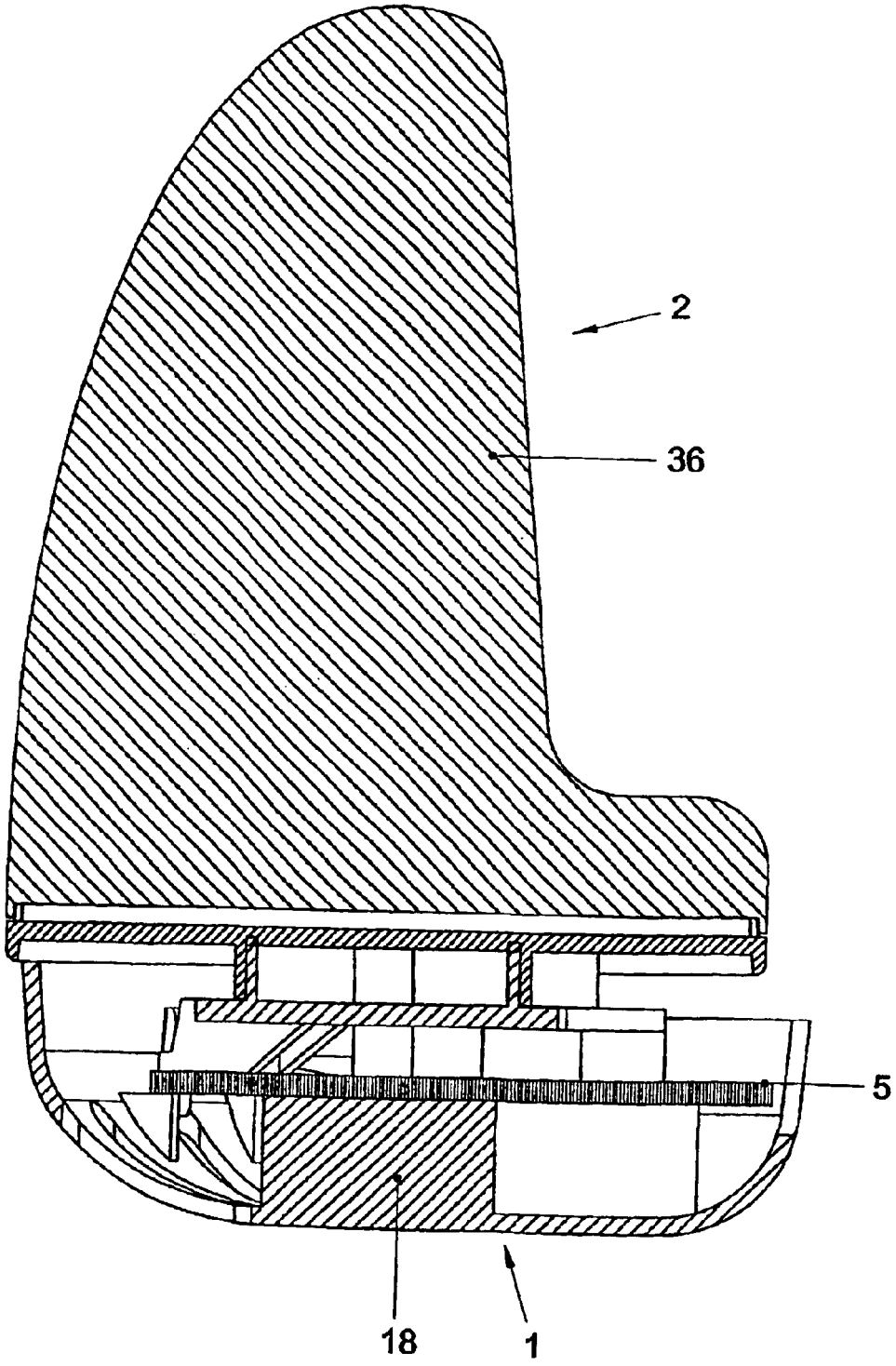
FIG. 6 shows a longitudinal section of this exemplary embodiment, perpendicular to the longitudinal section of FIG. 1 at the location indicated with E in FIG. 1.
Figure 7:
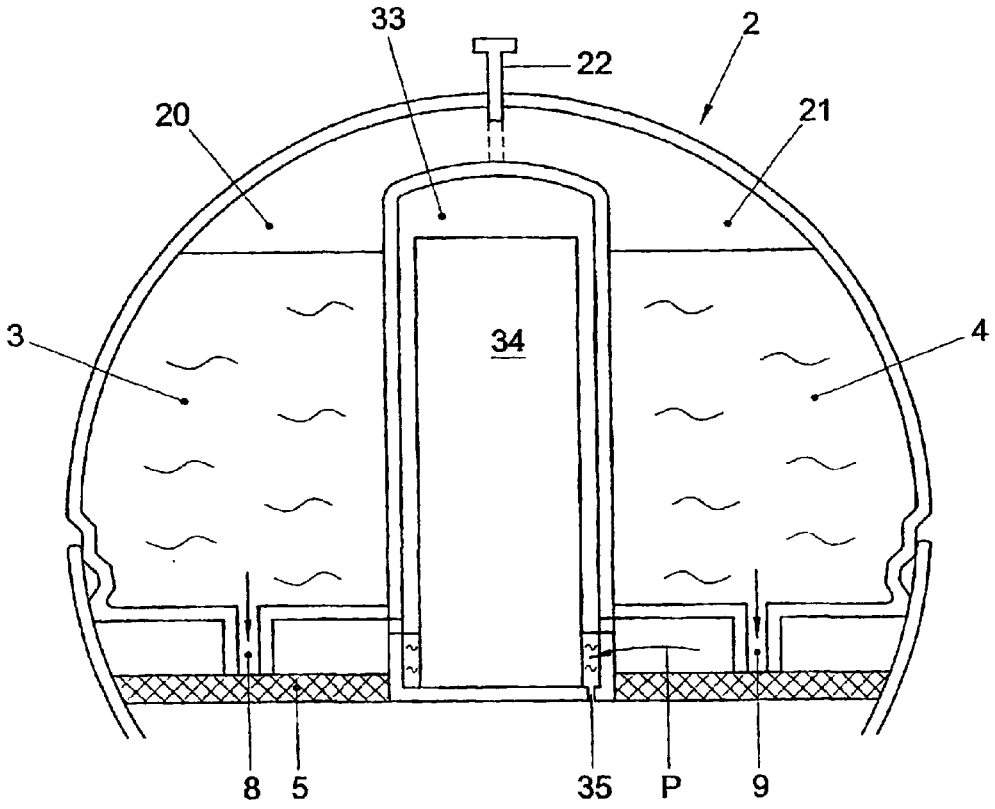
FIG. 7 shows a schematically represented exemplary embodiment where a cleansing block, disposed upright in a compartment, is incorporated in a partly represented further exemplary embodiment of the device according to the invention.

In the exemplary embodiment described here, the reservoir of the bottle is provided with two compartments. However, several compartments can be present. This is represented in a schematic manner in FIG. 7. In addition to the two liquid compartments 3 and 4, whose air spaces 20 and 21, again, can be brought into communication with each other with the aid of a connecting element 22, between these two compartments 3 and 4, a third compartment 33 is provided, in which, in this exemplary embodiment, a fixed cleansing block 34, vertically disposed, is provided. This compartment 33 is arranged such that with a flushing operation in a manner indicated with the arrow P, an amount of flushing water is vitually directly brought into the compartment via flushing water supply openings disposed at the bottom, at a distance of the compartment 33. Via a narrow discharge opening 35, during several minutes, the flushing water with the substance of the cleansing block 34 dissolved therein flows into the toilet bowl to effect a cleansing action therein. Here, the discharge opening 35 is located at approximately the same height as the porous element 5.

FIGS. 8–28 relate to a third exemplary embodiment according to the invention. First, the various moulded parts will be discussed separately and thereafter the exemplary embodiment in assembled condition.

Figure 8:
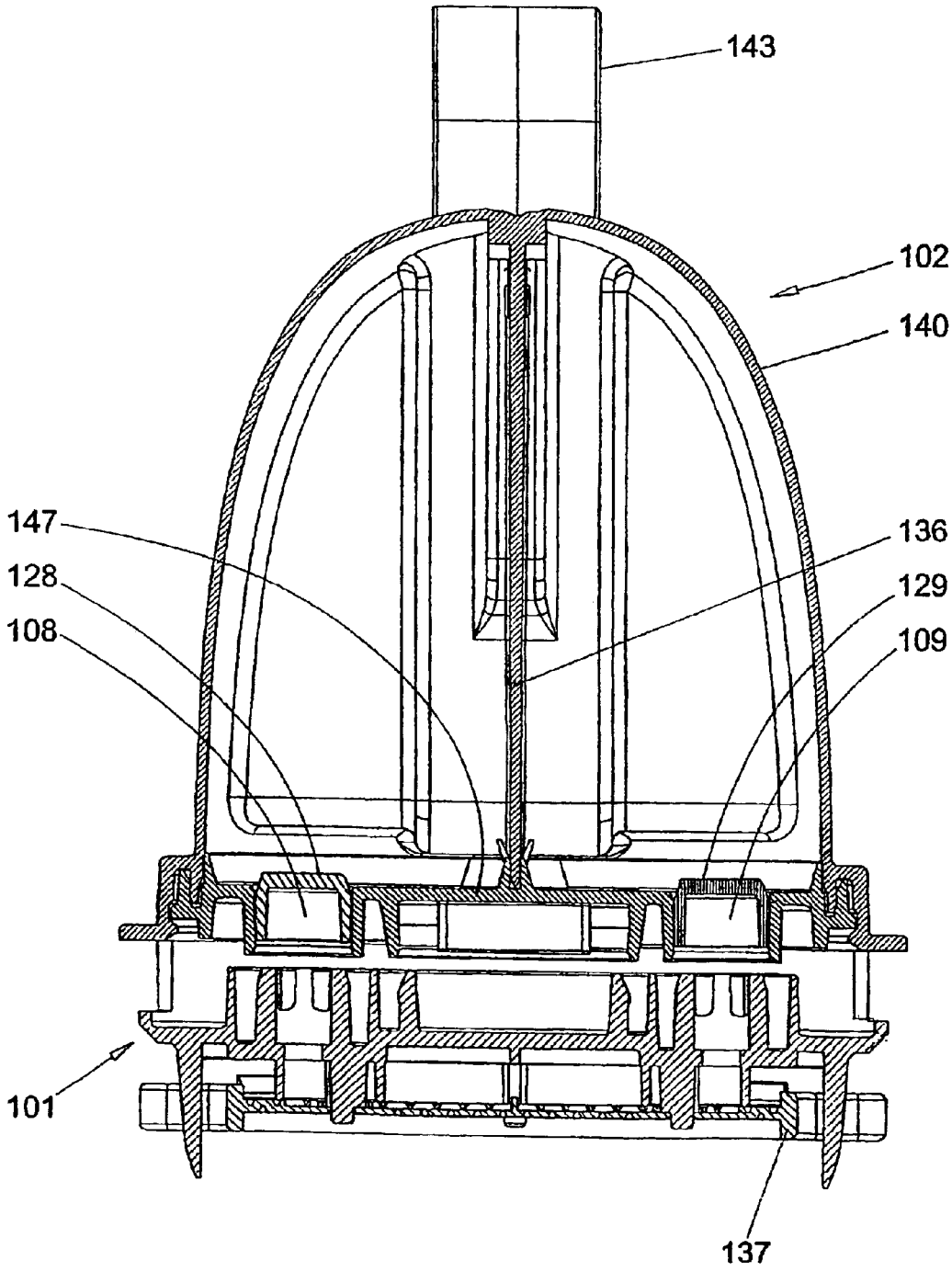
FIG. 8 shows a cross sectional view along the line XXIV—XXIV of FIG. 22 through the discharge openings of a third exemplary embodiment according to invention, wherein the bottle is not yet placed on the holder.

FIG. 8 shows a longitudinal cross section passing through the discharge openings of the bottle 102, whereby the bottle 102 has not yet been placed on the holder 101. As with the exemplary embodiment of FIGS. 1–6, the bottle 102 has been manufactured from four moulded parts, i.e. the reservoir (the first moulded part shown in FIGS. 9 and 10) the bottom of which is closed off with a closing cap (the second moulded part shown in FIGS. 11 and 12). The closing cap 147 supports the two tubular elements 123, 124, in which the rod-shaped closing elements 126, 127 (the third moulded parts shown in FIG. 13) are included. These rod-shaped elements 126,127 are formed by separate moulded parts. In the closing cap 147, the liquid discharge openings 108, 109 are closed off by sealing plugs 128, 129 (the fourth moulded parts shown in FIGS. 14 and 15). The suspension means 143 are formed by a separate moulded part (FIGS. 16 and 17) which, after having been injection-moulded, is connected to the holder 101. The holder 101, which is also a separate moulded part, is represented in FIGS. 18 and 19. To the bottom side of this holder, a liquid collecting element 173 (FIGS. 20 and 21), in this example manufactured by injection-moulding, can be attached.

Before proceeding to the discussion of the manner in which the various moulded parts cooperate in assembled condition, first, the moulded parts will be discussed separately.

Figure 9:
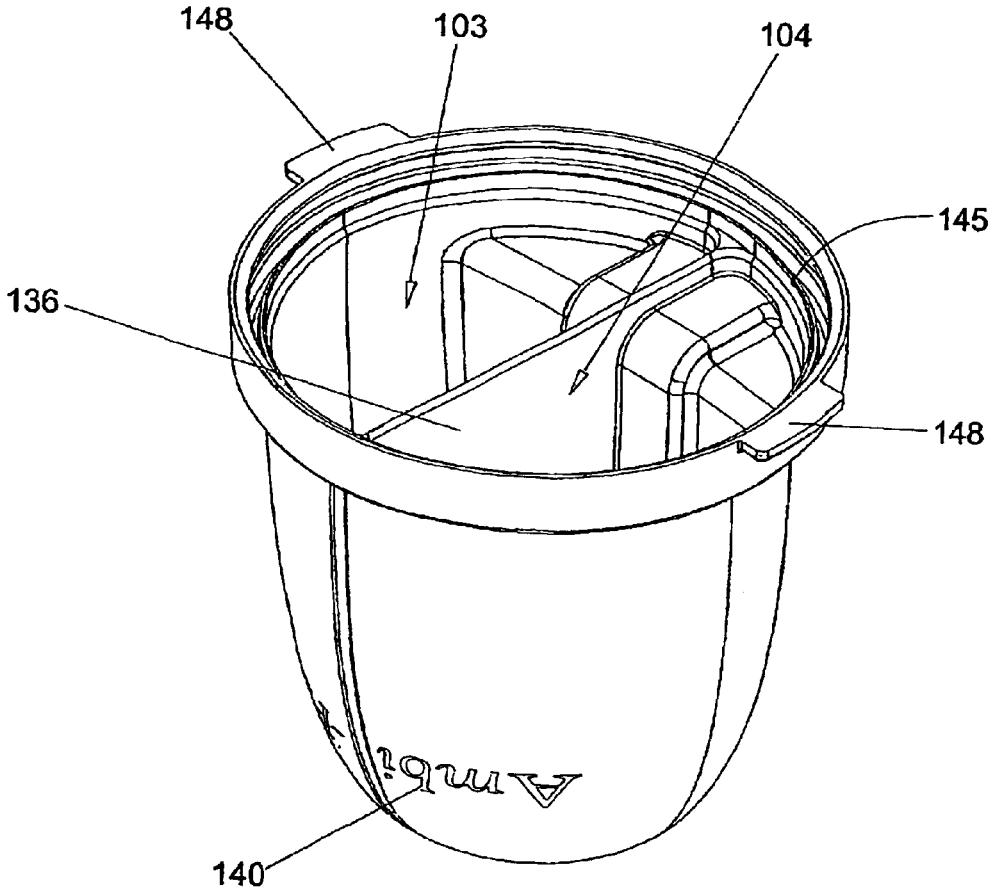
FIG. 9 shows a perspective view of the bottom side of the bottle.
Figure 10:
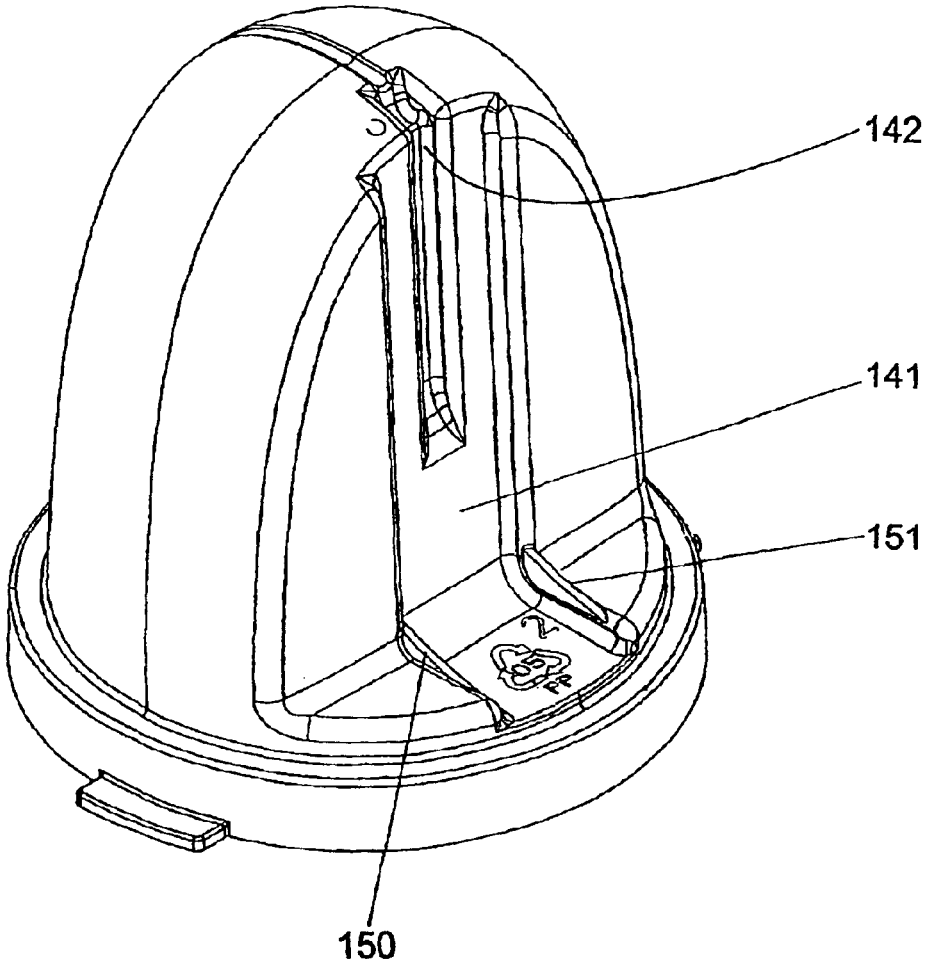
FIG. 10 shows a perspective view of the upper side of the bottle.
Figure 11:
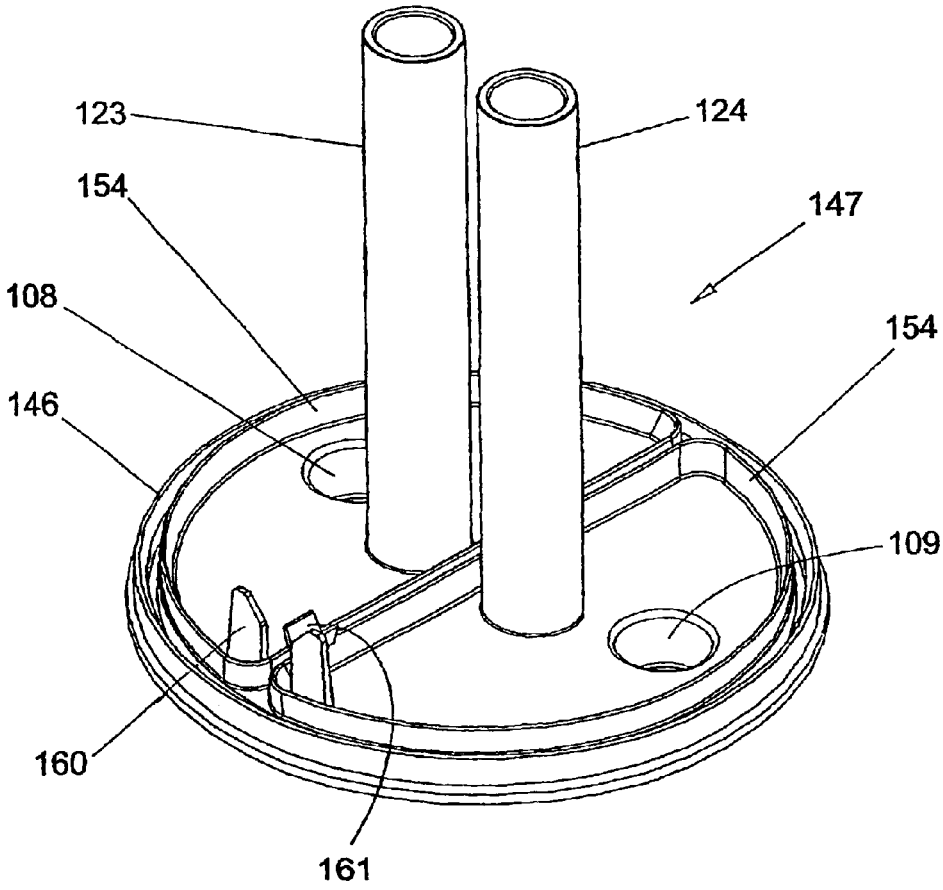
FIG. 11 shows a perspective view of the upper side of the closing cap.
Figure 12:
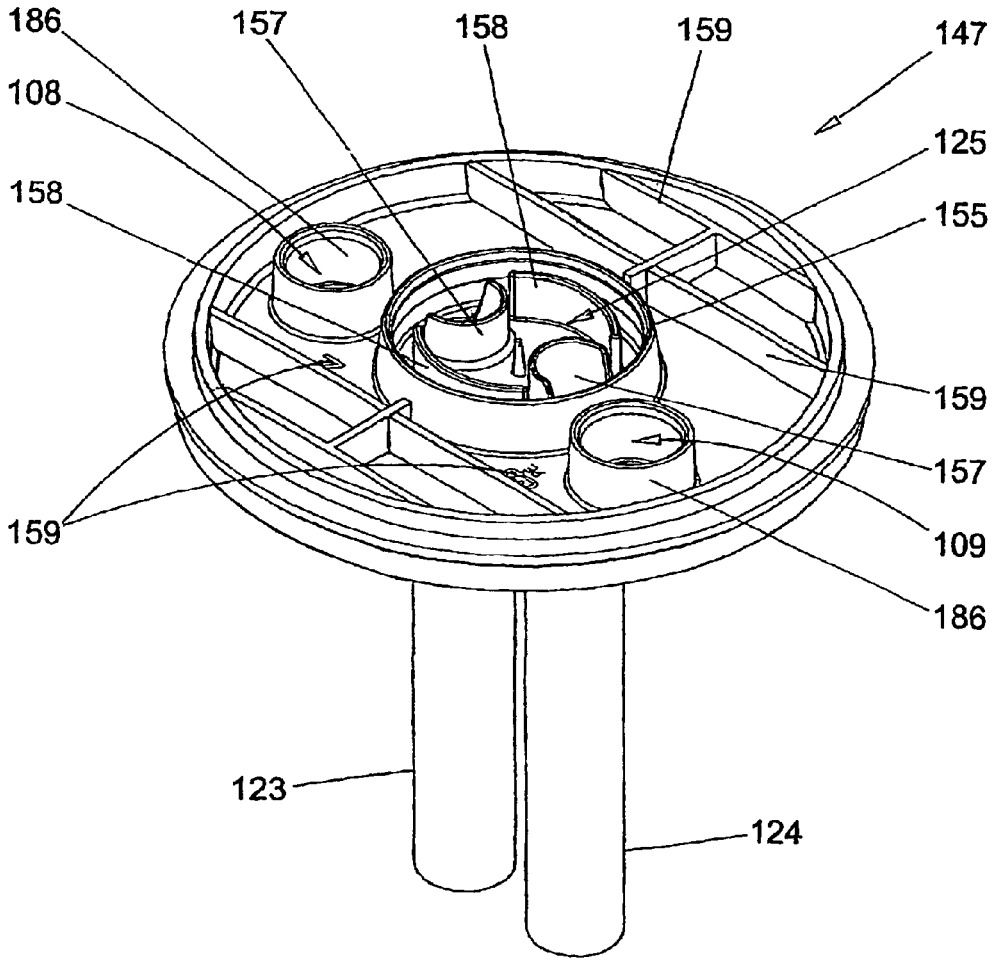
FIG. 12 shows a perspective view of the bottom side of the closing cap.

The reservoir shown in FIGS. 9 and 10 comprises an outer wall 140 bounding an inner space in which a dividing wall 136 is arranged. The outer wall 140 and the dividing wall 136 together bound two compartments 103, 104, which, in use, each contain an active liquid with a different formula. FIG. 10 shows the side of the reservoir against which the suspension means 143 is to abut. A recess 141 is clearly represented having the width of the suspension means 143. Also, a deeper recess 142 is represented in which a hooking element 144, disposed on the suspension means 143, can engage. FIG. 9 clearly shows a sealing rim 145 which cooperates with a sealing rim 146 on the closing cap 147 which is represented in FIGS. 11 and 12. Further, the reservoir is provided with two ears 148, 149 and two guiding partitions 150, 151, which are to simplify the fitting of the reservoir to the holder 101.

As already noted hereinabove, the closing cap represented in FIGS. 11 and 12 supports the two tubular elements 123, 124 in which the rod-shaped closing elements 126, 127 (FIG. 13) are included. The closing cap 147 is further provided with two discharge openings 108 and 109 in which, in non-assembled condition, sealing plugs 128, 129 are received. The closing cap 147 of FIGS. 11 and 12 further clearly shows the sealing edge 146 which cooperates with the sealing edge 145 of the reservoir. Further, two second sealing edges 154, closed in themselves, are shown which abut against the compartment walls of the reservoir. The bottom side of the closing cap 147, which is represented in FIG. 12, clearly shows the air chamber 125 which is bounded by a sealing wall 155, which, in assembled condition, cooperates with a sealing edge 156 engaging thereon in the holder 101. Further, two screening elements 157 are visible, which prevent the rod-shaped closing elements 126, 127 from being inadvertently pushed into the opened position. The screening elements 158 prevent the closing wall 155 from becoming damaged before the bottle 102 is fitted onto the holder 101. With reference numeral 159, reinforcing partitions are indicated preventing the closing cap 147 from warping. With reference numerals 160 and 161, centring elements are indicated which enable a simple assembly of the reservoir on the closing cap 147.

Figure 13:
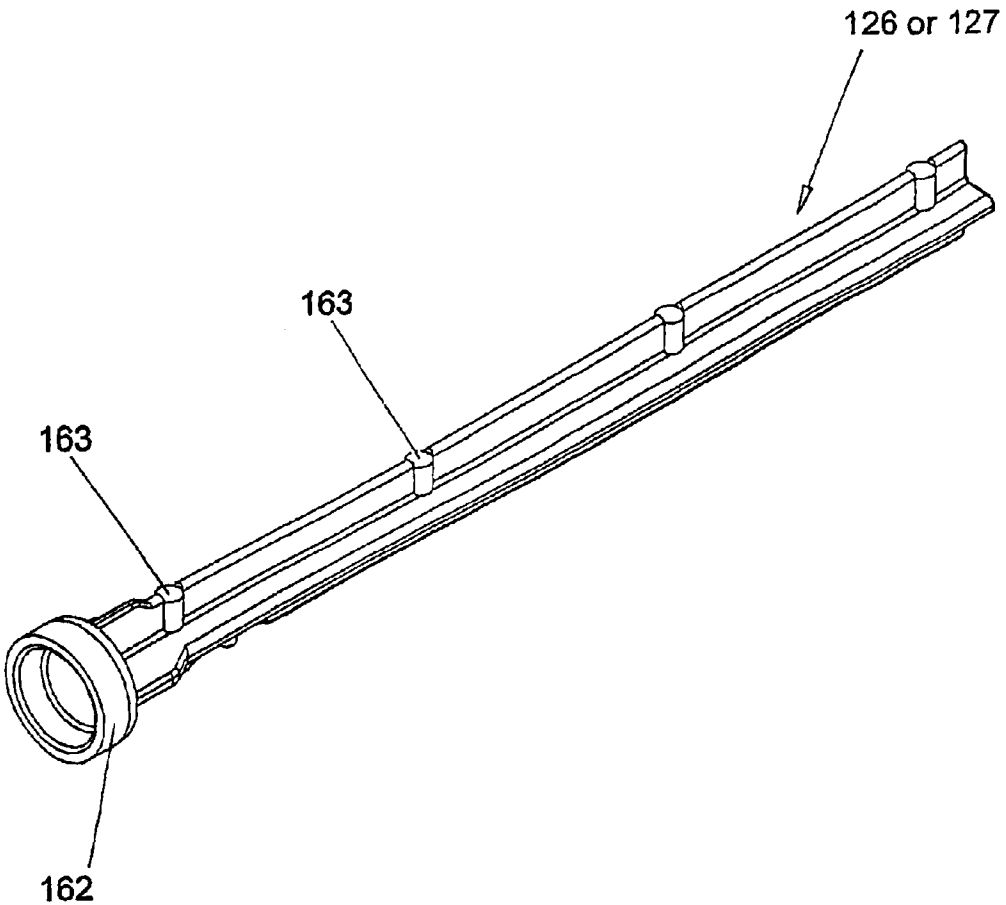
FIG. 13 shows a perspective view of a closing element.

The rod-shaped element represented in FIG. 13 is provided with a sealing head 162 which seals off an upper side of a tubular element 123, 124 of the closing cap 147 in an air-tight manner, in the non-assembled condition of the bottle 102. The cylinder-shaped parts 163 represented on the shank form the locations where the rod-shaped element is ejected from the mould and is injected.

Figure 15:
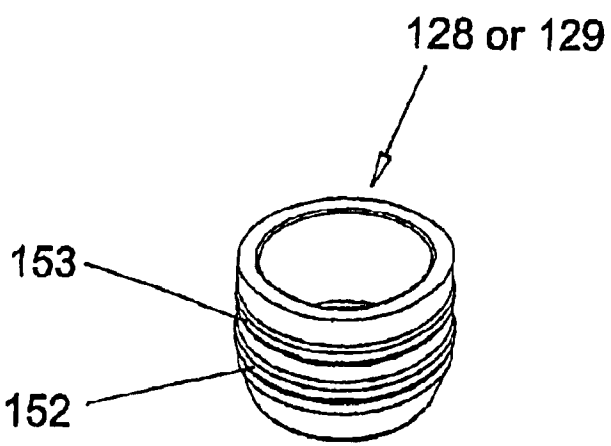
FIGS. 14 and 15 show a perspective top plan view and bottom plan view, respectively, of a closing cap.
Figure 14:
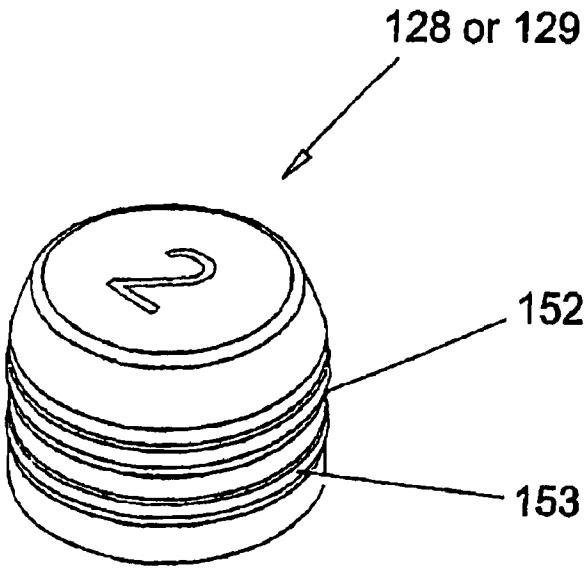

The sealing caps 128, 129 which are represented in FIGS. 14 and 15 are provided with a number of rims 152, 153 which provide for the sealing action of the sealing caps 128, 129.

The suspension means of FIGS. 16 and 17 are designed as a flexible bracket 143 which can be bent around the rim of a toilet bowl. Onto the bracket 143, the earlier-mentioned hooking element 144 is attached. Further, a rib 164 is fitted on the bracket for centring the bracket 143 relative to the bottle 102. FIG. 17 clearly shows the nose 165 of the bracket 143 which is pushed into the holder 101. On the nose, a stop 166 is provided which bounds the insertion of the nose 165 into the holder 101. With 167, a reinforcing rib is indicated which prevents the bracket 143 from bending on that spot. On the other free extremity of the bracket 143, ribs 168 are provided for preventing the bracket 143 from sliding from the rim of the toilet. Furthermore, these ribs provide an embellishment to the bracket 143.

FIG. 18 shows a bottom view of the holder 101 and FIG. 19 shows a top plan view of the holder 101. The holder 101 is provided with a circumferential edge 169 for placing the bottle 102 therein. The ascending edge 170 simplifies placement of the bottle 102. Slots 171 serve for a good discharge of water. Second slots 172 provide for a good supply of water to the liquid collecting element 173. With reference numeral 174, an opening is indicated in which the nose 165 of the flexible bracket 143 can be received. Reference numeral 175 indicates two projections with the aid of which the rod-shaped elements 126, 127 are pushed upwards when placing the bottle 102. When an excess pressure threatens to occur in the bottle 102, for instance as a result of a temperature rise in the toilet space, the active liquid will be pushed out via the discharge openings 108, 109. To prevent all this liquid from ending up directly on the liquid collecting element 173, the holder 101 is provided with a buffer chamber 176, 177 at each discharge opening 108, 109. In these buffers chambers 176, 177, each time, four projections 178 are disposed which push the sealing cap 128, 129 from the discharge openings 108, 109 when placing the bottle 102 onto the holder 101. In FIG. 19, also, clearly, bypass slots 179 are visible via which, at an excess pressure in the bottle 102, the active liquid can flow into the buffer chamber 176, 177. Naturally, via these bypass slots 179 the active liquid also flows back into the bottle 102 when the pressure decreases therein. Primarily, however, these bypass slots have the function of air supply to the compartments of the bottle 102. Further, FIG. 19 clearly shows the earlier-mentioned sealing edge 156 which cooperates with the closing wall 155 of the closing cap 147. Further, around the sealing edge 156, a protective wall 180 is arranged which prevents the closing wall 156 from becoming damaged upon placement of the bottle 102. In the bottom view of FIG. 18, clearly, three projections 181, 182 are shown which cooperate with three openings 194, 195 in the liquid collecting element 173 for keeping this liquid collecting element 173 in its place. Also, clearly, two discharge openings 183, 184 are visible via which the active liquid reaches the liquid collecting element 173. The partitions 185 serve for increasing the stability of the holder 101. Around the discharge openings 183, 184, cylindrical walls 188 are arranged which, in assembled condition, abut with a free end face against this liquid collecting element 173.

FIGS. 20 and 21 show the liquid collecting element 173 which is provided with a network of grooves 189, 190 among which radial grooves 189 extending radially from central discharge areas 192, 193. The liquid collecting element 173 is further provided with circular grooves 190 whose imaginary centre coincides with the centre of the discharge areas 192, 193. Also on a bottom side, the liquid collecting element 173 is provided with circular grooves 196, which is shown in FIG. 21. Via a large number of small holes 191, the upper surface and the bottom surface of the liquid collecting element 173 are in communication with each other, so that active liquid can accumulate both on the upper surface and on the bottom surface of the liquid collecting element 173. In FIG. 21, it is clearly visible that the circumference of the liquid collecting element 173 is bounded by a depending edge 197 which prevents active liquid present in the grooves 196 from being flushed away upon a flushing operation. Also, two projections 198 are represented with the aid of which the liquid collecting element 173 rests against the wall of the toilet bowl. Also, a centre partition 199 is shown located at the upper side of the liquid collecting element 173 and which prevents the different active liquids from mixing with each other. Further, clearly, the openings 194, 195 are shown on which the projections 181, 182 of the holder 101 engage for connecting the liquid collecting element 173 to the holder 101.

In the present exemplary embodiment of the liquid collecting element 173, the holes 191 are formed in that the grooves 196 in the bottom surface intersect the radial grooves 189 in the upper surface.

As the active liquid, upon a flushing operation of the toilet, will not or hardly be flushed away from the bottom side of the liquid collecting element 173, this bottom side of the liquid collecting element 173 serves as liquid buffer for rapidly replenishing the upper side of the liquid collecting element 173 with active liquid after a flushing operation.

It is noted that instead of the network of grooves 189, 190, the liquid collecting element can also be provided with other means for guiding active liquid thereover. For instance, these other means may comprise a brush-like structure which is arranged on both sides of the substantially plate-shaped liquid collecting element 173. Also, a pattern of indentations or projections arranged in a regular or irregular manner may form the means for guiding the active liquid over the liquid collecting element 173. Examples of such alternative structures are shown in FIG. 28. Here, it should be noted that due to the presence of small holes 191 in the liquid collecting elements 173, in all these embodiments of the liquid collecting element 173, the bottom side of the liquid collecting element 173 may serve as a buffer for active liquid from which buffer the upper side of the liquid collecting element 173, after a flushing operation of the toilet, can be replenished, so that a large evaporation surface is obtained and a substantial amount of active substance is available for evaporation directly after the flushing operation. The advantage of a thus designed liquid collecting element 173 is that it can be manufactured in a simple manner with the aid of an injection-moulding process, so that each liquid collecting element 173 has the same defined properties. When using a porous material, such as, for instance, Porex, these defined properties are not guaranteed. As a result thereof, it may occur that the absorption of the active liquid from the left-hand compartment proceeds substantially more rapidly than the absorption of the active liquid from the right-hand compartment or vice versa. The means for guiding the active liquid, disposed on opposite sides of the plate-shaped element, thus form a sort of porous mass with accurately defined, reproducible absorption properties.

FIG. 22 shows a side view of the third exemplary embodiment. Clearly visible are the flexible bracket 143, the bottle 102, the holder 101, the liquid collecting element 173 and the manner in which these parts are connected to each other in assembled condition.

From FIG. 23, which shows a cross section along the line XXIII—XXIII of FIG. 22 passing through the tubular elements 123, 124, it clearly appears that the rod-shaped elements 126, 127 have been pushed upwards by the two projections 175 of the holder 101, so that the sealing heads 162 of the rod-shaped elements 126, 127 have been pushed out of the tubular elements 123, 124. In this manner, an air communication is brought about between the two compartments 103, 104 via the pressure-equalizing chamber 125 which is bounded by the sealing edge 156 of the holder 101 and closing wall 155 of the closing cap 147. As a result of this air communication, the liquid level in the two compartments 103, 104 remains always the same. Even when there is a substantial difference in viscosity of the two liquids in the respective compartments 103, 104, as a result of the pressure-equalizing chamber 125, the substantially equal liquid level is still maintained.

The cross-sectional view XXIII—XXIII further shows that the sealing caps 128, 129 are pushed out of the discharge openings 108, 109 of the closing cap 147.

FIG. 24 shows a cross-sectional view along the line XXIV—XXIV of FIG. 22, which cross section passes through the discharge openings 108, 109 of the bottle 102. The cylindrical walls 186, bounding the discharge openings 108, 109, engage on the projection-supporting cylindrical parts 187 of the holder 101. Meanwhile, the projections 178 have pushed the sealing caps 128, 129 from the discharge openings 108, 109 of the closing cap 147. The cylindrical sealing edge 156 sealingly cooperates with the cylindrical closing wall 155 of the closing cap 147. FIG. 24 further shows the manner in which the liquid collecting element 173 is fitted on the projections 181, 182. Further, clearly, the vertical wall parts of the buffer chambers 176, 177 are visible. It is also clearly shown that the free end faces of the cylindrical walls 188 abut against the liquid collecting element 173. As already indicated hereinabove, the cylindrical parts 187 comprise bypass slots 179 via which liquid can flow from the bottle 102 to the buffer chambers 176, 177, at an excess pressure in this bottle 102. These bypass slots 179 are each clearly visible in the cross-sectional view along the line XVI—XVI of FIG. 24, which cross-sectional view is represented in FIG. 26. These bypass slots 179 also serve for the supply of air to the compartments when the reduced pressure in these compartments becomes too high.

The cross-sectional view of FIG. 25 clearly shows the manner in which the suspension means 143 is attached to the holder 101 and cooperates with the bottle 102. Also, the position of the liquid collecting element 173 in the holder 101 is clearly visible.

FIG. 26 clarifies in what manner the liquid collecting element 173 is positioned in the holder 101. Also, the buffer chambers 176, 177 are clearly visible having therein the bypass slots 179 which also form the air supply for the compartments. Also, the sealing edge 156 of the holder 101 and the closing wall 155 of the closing cap 147 are shown. The pressure-equalizing chamber 125 and the projections 175 present therein for pushing the closing elements 126, 127 upwards are clearly visible in FIG. 26. The latter also holds for the second slots 172 which allow the passage of the flushing water to the liquid collecting element 173. Also, the slots 171 in the holder 101 for allowing flushing water with active liquid to pass from the holder 101 are also shown.

FIG. 27 shows a cross-sectional view along the line XXVII—XXVII of FIG. 24, the three projections 181, 182 of the holder 101 being shown with the aid of which the liquid collecting element 173 is connected to the holder 101.

Finally, as already indicated hereinabove, FIG. 28 shows a number of alternative structures which can be arranged on opposite sides of the substantially plate or tray-shaped liquid collecting element 173. Here, it should be noted that this is only a limited number of examples which can also comprise other structures such as injection-moulded brush structures or projections or indentations provided in a random pattern.

The invention is not limited to the exemplary embodiments described on the basis of the Figures, but comprises all sorts of modifications thereof, naturally in as far as they fall within the scope of the following claims.

What is claimed is:

1. A device with multiple toilet care action, provided with a reservoir for an active substance and suspension means for suspending the device from the rim of a toilet bowl such that with every flushing operation an active substance is imparted to the flushing water in the toilet bowl, wherein the reservoir is provided with at least two compartments for an active substance, and wherein the reservoir is provided with a solid-retaining compartment having disposed therein a block of an active substance which, when the device is suspended from the rim of the toilet bowl, is also located in the path of the flushing water in the toilet bowl for adding to the toilet bowl, with each flushing operation, an amount of the active substance dissolved in the flushing water.

2. A device according to claim 1, wherein the block is formed and disposed such that during the greatest part of its service life, during flushing operations, it only partly comes into contact with the flushing water.

3. A device according to claim 2, wherein the block is composed and disposed such that during the greatest part of the service life of the block, the part of it coming into contact with the flushing water, is constant.

4. A device according to claim 3, wherein the block is beam-shaped and is vertically disposed in the solid-retaining compartment.

5. A device according to claim 4, wherein the solid-retaining compartment is disposed between two liquid compartments.

6. A device according to claim 5, further comprising a liquid collecting element which, when the device is suspended from the rim of the toilet bowl, is located in the part of the flushing water in the toilet bowl for adding thereto with each flushing operation an active liquid, wherein the contents of the liquid compartments are in a constant communication with the liquid collecting element;

wherein the solid-retaining compartment is provided with a discharge opening which is located substantially at the same height as the liquid collecting element.

7. A rim-mounted active substance dispenser for toilet bowls comprising:

a reservoir, the reservoir including at least two compartments each compartment capable of being filled with an active liquid and having an air space in the volume not occupied by the active liquid;

at least one connecting element disposed between the at least two compartments, the connecting element equalizing the pressure in the at least two air spaces; and a bracket which fastens the dispenser to the rim of a toilet bowl, so that a portion of the at least one active liquid is dispensed into the bowl water when the toilet is flushed.

8. The dispenser of claim 7, further comprising:

a liquid collecting element disposed in the path of the toilet bowl water, the liquid collecting element being constantly liquidly connected to the at least two compartments, wherein the liquid collecting element imparts an amount of the at least one active liquid into the toilet bowl water during each flushing operation.

9. The dispenser of claim 8, further comprising:

a holder; and a bottle which houses the at least two compartments, the bottle detachably connected to the holder.

10. The dispenser of claim 9, wherein the connecting element seals off each of the at least two compartments before the bottle is attached to the holder.

11. The dispenser of claim 10, the connecting element further comprising a release which connects the at least two air spaces when the bottle is attached to the holder.

12. The dispenser of claim 11, wherein:

the reservoir includes only two compartments;

the dispenser includes only one connecting element;

the connecting element comprises two open, tubular elements, each disposed in one of the two compartments, the two tubular elements having lower ends in communication with each other and upper ends that terminate in a common air space; and the release comprises two rod-shaped elements, wherein the rod-shaped elements extend through and seal the two tubular elements before the bottle is attached to the holder, and connect the air spaces when the bottle is attached to the holder.

13. The dispenser of claim 9, wherein the bottle houses the reservoir, and the each of the at least two compartments houses a different active liquid.

14. The dispenser of claim 8, the reservoir further comprising a solid-retaining compartment capable of housing an active solid, so that a portion of the active solid is dispensed into the bowl water when the toilet is flushed.

15. The dispenser of claim 14, wherein the solid-retaining compartment is disposed such that an active solid housed in the solid-retaining compartment is brought only partly into contact with the bowl water during each flushing operation.

16. The dispenser of claim 15, wherein the solid-retaining compartment is disposed such that an active solid housed in the solid-retaining compartment contacts the bowl water only at the bottom of the active solid.

17. The dispenser of claim 16, further comprising an active solid, the active solid being beam-shaped, vertically disposed and housed in the solid-retaining compartment.

18. The dispenser of claim 14, wherein the solid-retaining compartment is disposed between the at least two compartments.

19. The dispenser of claim 14, wherein the solid-retaining compartment further comprises a discharge element which is located substantially at the same height as the liquid collecting element.

20. A rim-mounted active substance dispenser for toilet bowls, comprising:

a reservoir, the reservoir including at least two compartments, each compartment capable of being filled with an active liquid and having an air space in the volume not occupied by the active liquid;

a liquid collecting element disposed in the path of the toilet bowl water, the liquid collecting element being constantly liquidly connected to the at least two compartments, wherein the liquid collecting element imparts an amount of the at least one active liquid into the toilet bowl water during each flushing operation; and a bracket which fastens the dispenser to the rim of a toilet bowl, so that a portion of the at least one active liquid is dispensed into the bowl water when the toilet is flushed.

* * * * *